US008783343B2

(12) United States Patent
Giroux et al.

(10) Patent No.: US 8,783,343 B2
(45) **Date of Patent: *Jul. 22, 2014**

(54) TOOLS AND METHODS FOR HANGING AND/OR EXPANDING LINER STRINGS

(71) Applicant: Weatherford/Lamb, Inc., Houston, TX (US)

(72) Inventors: Richard Lee Giroux, Cypress, TX (US); Michael J. Lynch, Katy, TX (US); Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/973,120

(22) Filed: Aug. 22, 2013

(65) Prior Publication Data

US 2013/0333873 A1 Dec. 19, 2013

Related U.S. Application Data

(63) Continuation of application No. 13/649,870, filed on Oct. 11, 2012, now Pat. No. 8,567,515, which is a continuation of application No. 12/436,073, filed on May 5, 2009, now Pat. No. 8,286,717.

(60) Provisional application No. 61/050,511.

(51) Int. Cl.
*E21B 23/00* (2006.01)

(52) U.S. Cl.
USPC ..... 166/208; 166/382; 166/120; 166/66.6

(58) Field of Classification Search
USPC ..... 166/382, 120, 208, 386, 66.6
See application file for complete search history.

(56) References Cited

U.S. PATENT DOCUMENTS

| | | | |
|---|---|---|---|
| 3,233,674 | A | 2/1966 | Leutwyler |
| 3,669,190 | A | 6/1972 | Sizer et al. |
| RE29,471 | E | 11/1977 | Giroux |
| 4,224,986 | A | 9/1980 | Rothberg |
| 4,224,993 | A | 9/1980 | Huckaby |

(Continued)

FOREIGN PATENT DOCUMENTS

CA 2298298 A1 8/2000

OTHER PUBLICATIONS

Fraley, Karen et al.—"RFID Technology for Downhole Well Applications," Exploration and Production—Oil & Gas Review 2007—OTC Edition, pp. 60-62.

(Continued)

*Primary Examiner* — Cathleen Hutchins
(74) *Attorney, Agent, or Firm* — Patterson & Sheridan, LLP

(57) ABSTRACT

Embodiments of the invention generally relate to tools and methods for hanging and/or expanding liner strings. In one embodiment, a method of hanging a liner assembly from a previously installed tubular in a wellbore includes running the liner assembly and a setting tool into the wellbore using a run-in string. The setting tool includes an isolation valve and the liner assembly includes a liner hanger and a liner string. The method further includes sending an instruction signal from the surface to the isolation valve, wherein the isolation valve closes in response to the instruction signal and isolates a setting pressure in the setting tool from the liner string; and increasing fluid pressure in the setting tool, thereby setting the liner hanger.

7 Claims, 31 Drawing Sheets

(56) References Cited

U.S. PATENT DOCUMENTS

| | | | | |
|---|---|---|---|---|
| 5,203,414 | A | 4/1993 | Hromas et al. | |
| 5,558,153 | A | 9/1996 | Holcombe et al. | |
| 5,615,741 | A | 4/1997 | Coronado | |
| 5,706,896 | A | 1/1998 | Tubel et al. | |
| 5,785,120 | A | 7/1998 | Smalley et al. | |
| 6,021,095 | A * | 2/2000 | Tubel et al. | 367/82 |
| 6,055,213 | A | 4/2000 | Rubbo et al. | |
| 6,343,649 | B1 | 2/2002 | Beck et al. | |
| 6,349,772 | B2 | 2/2002 | Mullen et al. | |
| 6,408,945 | B1 | 6/2002 | Telfer | |
| 6,443,228 | B1 | 9/2002 | Aronstam et al. | |
| 6,536,524 | B1 | 3/2003 | Snider | |
| 6,736,210 | B2 | 5/2004 | Hosie et al. | |
| 6,776,240 | B2 | 8/2004 | Kenison et al. | |
| 6,802,373 | B2 | 10/2004 | Dillenbeck et al. | |
| 6,834,726 | B2 | 12/2004 | Giroux et al. | |
| 6,845,820 | B1 | 1/2005 | Hebert et al. | |
| 6,877,567 | B2 | 4/2005 | Hirth | |
| 6,892,819 | B2 | 5/2005 | Cook et al. | |
| 6,997,266 | B2 | 2/2006 | Jackson et al. | |
| 7,011,162 | B2 | 3/2006 | Maguire | |
| 7,044,229 | B2 | 5/2006 | Tennoy et al. | |
| 7,063,142 | B2 | 6/2006 | Cook et al. | |
| 7,093,656 | B2 | 8/2006 | Maguire | |
| 7,114,573 | B2 | 10/2006 | Hirth et al. | |
| 7,159,667 | B2 | 1/2007 | Cook et al. | |
| 7,172,021 | B2 | 2/2007 | Brisco et al. | |
| RE39,583 | E | 4/2007 | Upchurch | |
| 7,225,870 | B2 | 6/2007 | Pedersen et al. | |
| 7,225,880 | B2 | 6/2007 | Braddick | |
| 7,243,731 | B2 | 7/2007 | Watson et al. | |
| 7,252,152 | B2 | 8/2007 | LoGiudice et al. | |
| 7,290,616 | B2 | 11/2007 | Cook et al. | |
| 7,322,410 | B2 | 1/2008 | Vinegar et al. | |
| 7,363,691 | B2 | 4/2008 | Cook et al. | |
| 7,438,133 | B2 | 10/2008 | Brisco | |
| 7,556,092 | B2 | 7/2009 | Cook et al. | |
| 7,562,712 | B2 | 7/2009 | Cho et al. | |
| 7,603,758 | B2 | 10/2009 | Cook et al. | |
| 2001/0013411 | A1 * | 8/2001 | Beck et al. | 166/65.1 |
| 2004/0256113 | A1 | 12/2004 | LoGiudice et al. | |
| 2005/0006106 | A1 | 1/2005 | Hirth et al. | |
| 2005/0045342 | A1 | 3/2005 | Luke et al. | |
| 2005/0236162 | A1 | 10/2005 | Badrak et al. | |
| 2006/0065408 | A1 * | 3/2006 | Green et al. | 166/384 |
| 2006/0124295 | A1 | 6/2006 | Maguire | |
| 2007/0022800 | A1 * | 2/2007 | Zifferer et al. | 72/370.2 |
| 2007/0285275 | A1 | 12/2007 | Purkis et al. | |
| 2010/0252252 | A1 | 10/2010 | Harris et al. | |
| 2010/0252278 | A1 | 10/2010 | Harris et al. | |

OTHER PUBLICATIONS

Snider, Philip M. et al.—"RFID Downhole Tools and Development for the Drilling Environment," American Association of Drilling Engineers 2009 National Technical Conference & Exhibition, New Orleans, Louisiana, AADE 2009NTCE-16-04 Tech Paper, pp. 1-3.

EPO Search Report dated Nov. 21, 2013, in European Patent Application No. 09743522.6.

* cited by examiner

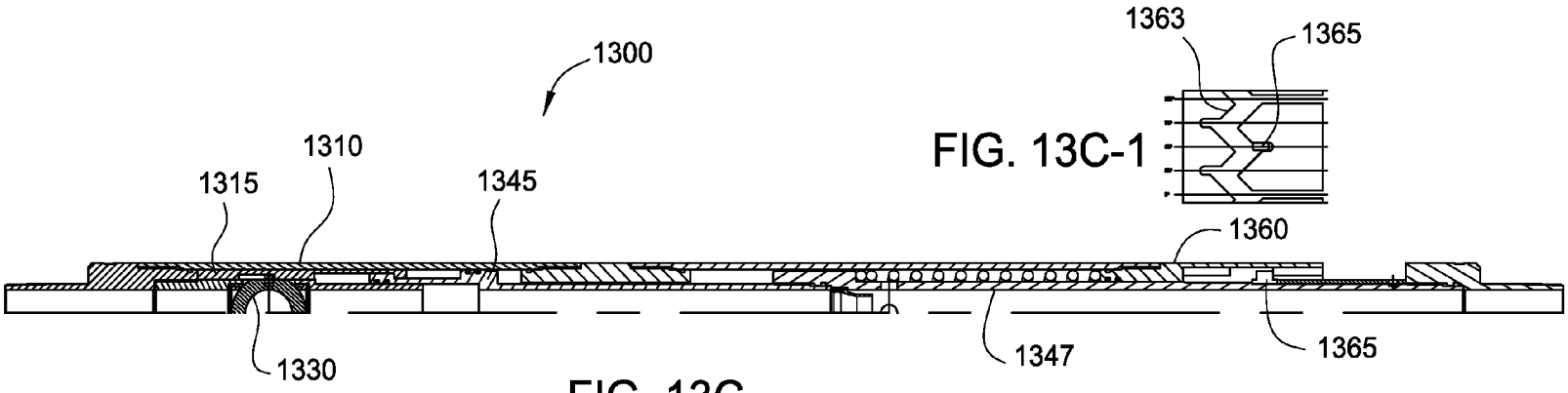
FIG. 13C-1
FIG. 13C
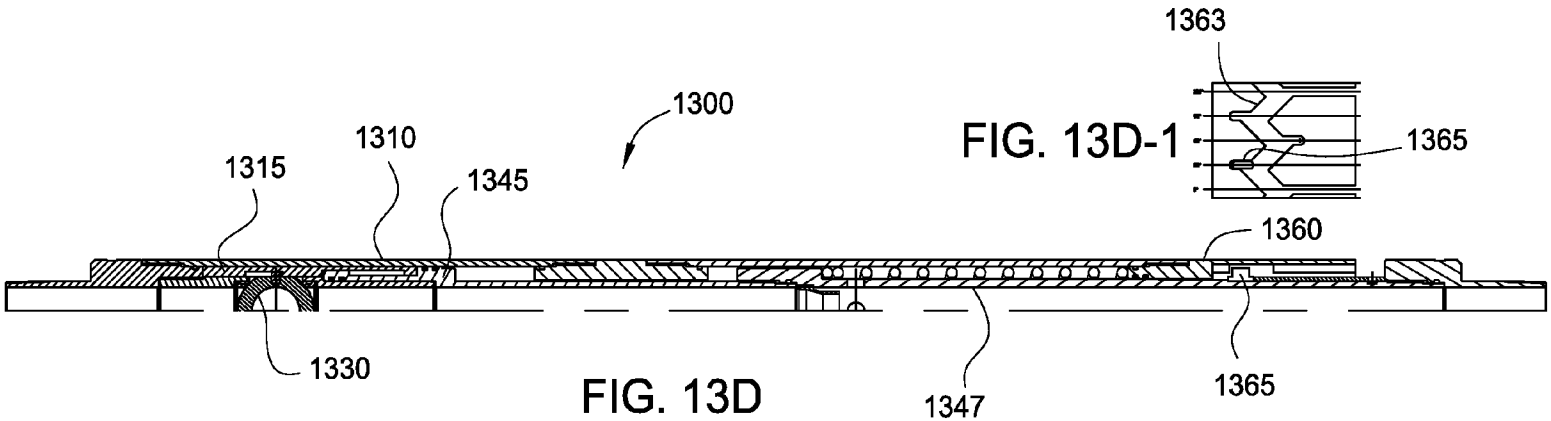
FIG. 13D-1
FIG. 13D 1541
1510
1535
1577
1575
1550
1511
1570
1530
1513

1600
1500
1525
1555
1560
685

1580
1535
1575
1500

1575
1570
1530
1555
1500
1560

1510
1590
1575
1500

TOOLS AND METHODS FOR HANGING AND/OR EXPANDING LINER STRINGS

BACKGROUND OF THE INVENTION

1. Field of the Invention

Embodiments of the present invention generally relate to tools and methods for hanging and/or expanding liner strings.

2. Description of the Related Art

In wellbore construction and completion operations, a wellbore is initially formed to access hydrocarbon-bearing formations (i.e., crude oil and/or natural gas) by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annular area with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the wellbore is drilled to a first designated depth with a drill bit on a drill string. The drill string is removed. A first string of casing is then run into the wellbore and set in the drilled out portion of the wellbore, and cement is circulated into the annulus behind the casing string. Next, the wellbore is drilled to a second designated depth, and a second string of casing or liner, is run into the drilled out portion of the wellbore. If the second string is a liner, the liner string is set at a depth such that the upper portion of the second liner string overlaps the lower portion of the first string of casing. The second liner string is then fixed, or "hung" off of the existing casing using a liner hanger to fix the new string of liner in the wellbore. The second liner string is then cemented. A tie-back casing string may then be landed in a polished bore receptacle (PBR) of the second liner string so that the bore diameter is constant through the liner to the surface. This process is typically repeated with additional liner strings until the well has been drilled to total depth. As more casing or liner strings are set in the wellbore, the casing or liner strings become progressively smaller in diameter in order to fit within the previous casing string. In this manner, wells are typically formed with two or more strings of casing and/or liner of an ever-decreasing diameter.

The process of hanging a liner off of a string of surface casing or other upper casing string involves the use of a liner hanger. The liner hanger is typically run into the wellbore above the liner string itself. The liner hanger is actuated once the liner is positioned at the appropriate depth within the wellbore. The liner hanger is typically set through actuation of slips which ride outwardly on cones in order to frictionally engage the surrounding string of casing. The liner hanger operates to suspend the liner from the casing string. However, it does not provide a fluid seal between the liner and the casing. Accordingly, a packer may be set to provide a fluid seal between the liner and the casing.

During the wellbore completion process, the packer is typically run into the wellbore above the liner hanger. A threaded connection typically connects the bottom of the packer to the top of the liner hanger. Known packers employ a mechanical or hydraulic force in order to expand a packing element outwardly from the body of the packer into the annular region defined between the packer and the surrounding casing string. In addition, a cone is driven behind a tapered slip to force the slip into the surrounding casing wall and to prevent packer movement. Numerous arrangements have been derived in order to accomplish these results.

The cementing process typically involves the use of liner wipers and drill-pipe plugs. A liner wiper is typically located inside the top of a liner, and is lowered into the wellbore with the liner at the bottom of a working string. The liner wiper plug typically defines an elongated elastomeric body used to separate fluids pumped into a wellbore. The wiper has radial wipers to contact and wipe the inside of the liner as the wiper travels down the liner. The liner wiper has a cylindrical bore through it to allow passage of fluids.

After a sufficient volume of cement has been placed into the wellbore, the plug is deployed. Using a displacement fluid, such as drilling mud, the plug is pumped into the working string. As the plug travels downhole, it seats against the liner wiper, closing off the internal bore through the liner wiper. Hydraulic pressure above the plug forces the plug and the wiper to dislodge from the bottom of the working string and to be pumped down the liner together. This forces the circulating fluid or cement that is ahead of the wiper plug and dart to travel down the liner and out into the liner annulus.

SUMMARY OF THE INVENTION

Embodiments of the present invention generally relate to tools and methods for hanging and/or expanding liner strings. In one embodiment, a method of hanging a liner assembly from a previously installed tubular in a wellbore includes: running the liner assembly and a setting tool into the wellbore using a run-in string. The setting tool includes an isolation valve and the liner assembly includes a liner hanger and a liner string. The method further includes sending an instruction signal from the surface to the isolation valve. The isolation valve closes in response to the instruction signal and isolates a setting pressure in the setting tool from the liner string. The method further includes increasing fluid pressure in the setting tool, thereby setting the liner hanger.

In another embodiment, a setting tool for hanging a liner assembly from a previously installed tubular in a wellbore, includes a tubular mandrel having a bore therethrough and a port formed through a wall thereof; a piston in fluid communication with the port and operable to set a liner hanger of the liner assembly; a latch operable to couple the liner assembly to the mandrel; a seal configured to isolate an annulus between the liner assembly and the setting tool; and an isolation valve. The isolation valve is operable to receive an instruction signal from the surface and close in response to receiving the instruction signal.

In another embodiment, a method of hanging a liner assembly from a previously installed tubular in a wellbore includes running the liner assembly and a setting tool into the wellbore using a run-in string. The setting tool includes a piston and an electric actuator and the liner assembly includes a liner hanger and a liner string. The method further includes sending an instruction signal from a surface to the electric actuator. The actuator supplies fluid pressure to the piston in response to the instruction signal, thereby setting the liner hanger.

In another embodiment, a setting tool for hanging a liner assembly from a previously installed tubular in a wellbore, includes: a tubular mandrel having a bore therethrough; a piston coupled to the mandrel and operable to set a liner hanger of the liner assembly; a latch operable to couple the liner assembly to the mandrel; a seal configured to isolate an annulus between the liner assembly and the setting tool and; an electric actuator. The actuator is operable to receive an instruction signal from a surface and supply fluid pressure to the piston.

In another embodiment, a method of expanding a liner in a wellbore, includes running the liner assembly and an expander assembly into the wellbore using a run-in string. The expander assembly includes an electric actuator and a two-position expander. The method further includes sending an instruction signal from a surface to the actuator; forming a launcher in the liner for the expander; shifting the two-position expander from a contracted position to an expanded position in the launcher by the actuator in response to the signal; and expanding the liner.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 13A-D are half-sections of an isolation valve and illustrate the operation of the isolation valve, according to another embodiment of the invention. FIGS. 13A-1, 13B-1, 13C-1 and 13D-1 illustrate a J-slot arrangement of the isolation valve and operation thereof. FIGS. 13A-2 and 13B-2 illustrate coupling between a ball and sleeve of the isolation valve and operation thereof.

FIGS. 15A-D are half-sections of an expansion assembly of an expandable liner system and illustrate the operation of the system, according to another embodiment of the invention. FIG. 15A-1 illustrates a piston and valve of the expandable liner system. FIGS. 15C-1, 15D-1, 15D-2 are half-sections of a release mechanism of the expandable liner system and illustrate the operation of the system.

DETAILED DESCRIPTION

Figure 1A:
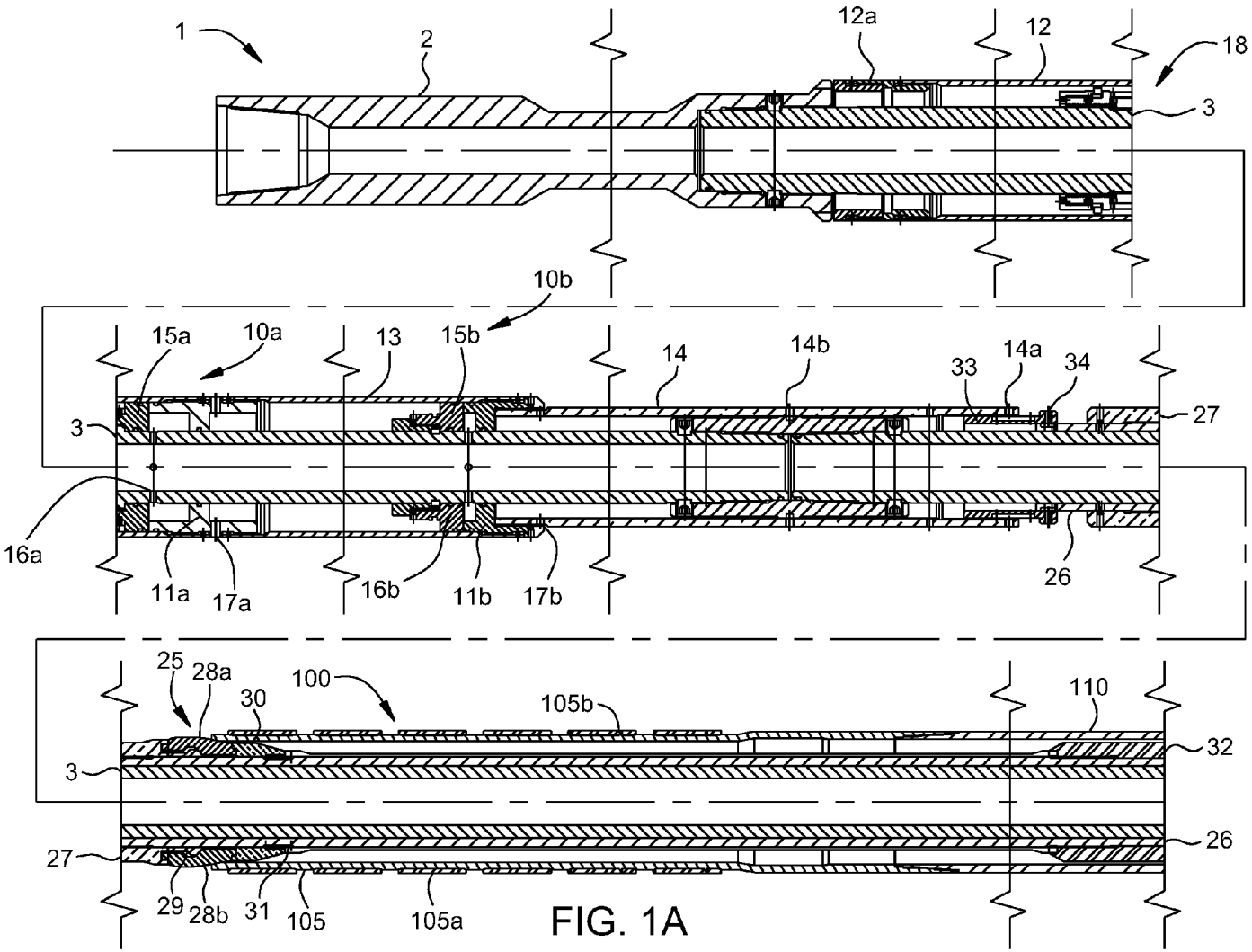
FIGS. 1A and 1B are cross-sections of a setting tool, a liner assembly, and a wiper assembly, according to one embodiment of the present invention.
Figure 1B:
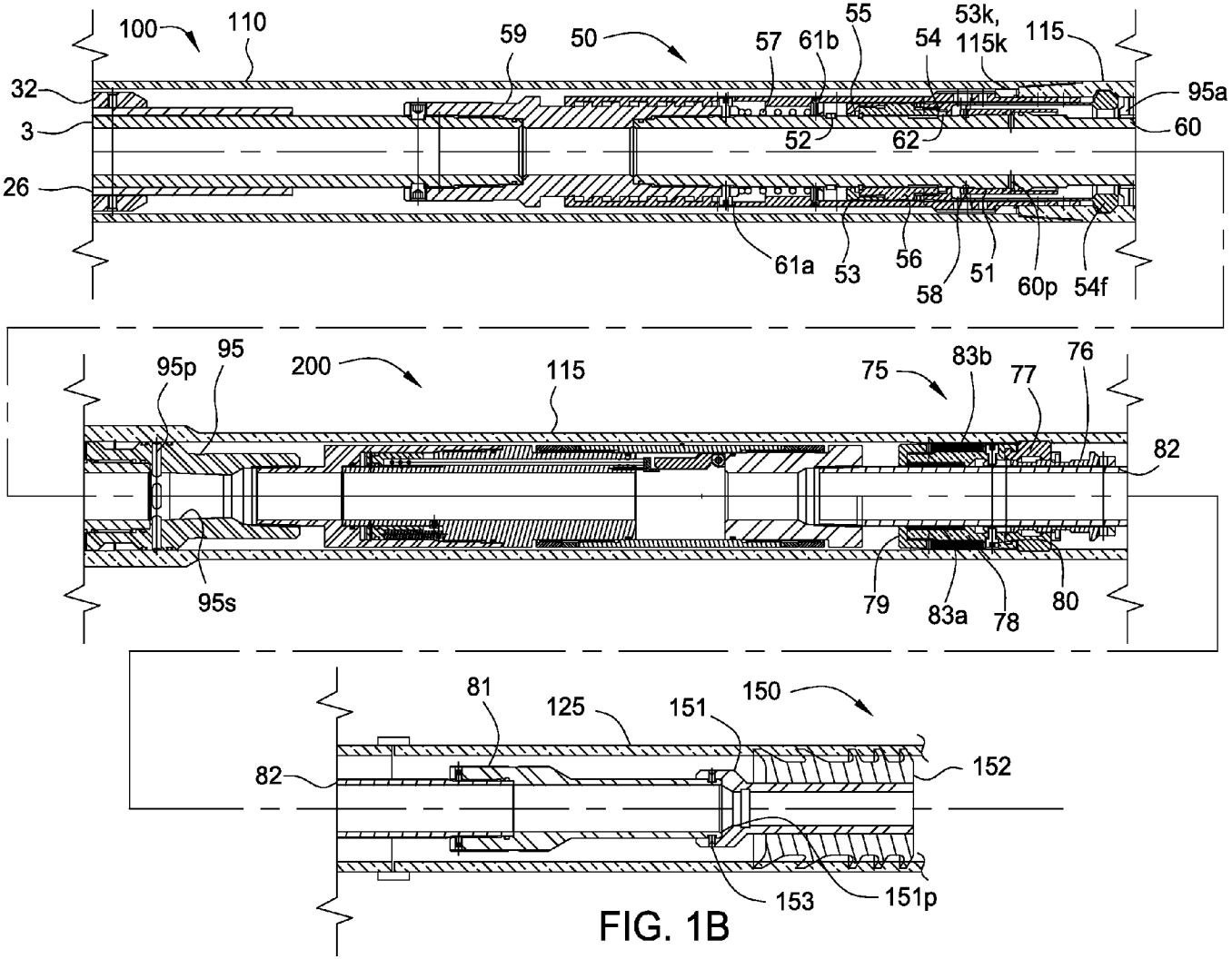

FIGS. 1A and 1B are cross-sections of a setting tool 1, a liner assembly 100, and a wiper assembly 150, according to one embodiment of the present invention. The setting tool 1, liner assembly 100, and wiper assembly 150 may be run into a wellbore using a run-in string 685 (see FIG. 6). The run-in string 685 may include a string of tubulars, such as drill pipe, longitudinally and rotationally coupled by threaded connections. The liner assembly 100 may include an expandable liner hanger 105, a polished bore receptacle (PBR) 110, one or more adapters 115, and a liner string 125. The setting tool 1 may be operable to radially and plastically expand the liner hanger 105 into engagement with a casing or liner string 305 (see FIG. 3A) previously installed in the wellbore. Non-sealing members of the setting tool 1 and liner assembly 100 may be made from a metal or alloy, such as steel or stainless steel. Alternatively, the PBR 110 may be disposed between the liner hanger and the run-in string.

The setting tool 1 may include a connector sub 2, a mandrel 3, one or more piston assemblies 10*a, b*, an expander assembly 25, a latch assembly 50, an isolation valve 200, and a seal assembly 75. The connector sub 2 may be a tubular member including a threaded coupling for connecting to the run-in string and a longitudinal bore therethrough. The connector sub 2 may also include a second threaded coupling engaged with a threaded coupling of the mandrel 3. One or more fasteners, such as set screws may secure the threaded connection between the connector sub 2 and the mandrel 3. The mandrel 3 may be a tubular member having a longitudinal bore therethrough and may include one or more segments connected by threaded couplings.

The piston assemblies 10*a,b* may include pistons 11*a,b*, sleeves 12-14, caps 15*a,b*, inlets 16*a,b*, outlets 17*a,b*, and ratchet assembly 18. The pistons 11*a, b* may each be T-shaped annular members. An inner surface of each piston 11*a,b* may engage an outer surface of the mandrel 3 and may include a recess having a seal, such as an o-ring disposed therein. The inlets 16*a,b* may be formed radially through a wall of the mandrel 3 and provide fluid communication between a bore of the mandrel 3 and first sides of the pistons 11*a,b*. The sleeves 12,13 may be longitudinally coupled to the pistons 11*a,b* by threaded connections. Seals, such as o-rings, may be disposed between the pistons 11*a,b* and the sleeves 12,13. Each of the sleeves 12-14 may be a tubular member having a longitudinal bore formed therethrough and may be disposed around the mandrel, thereby forming an annulus therebetween. The caps 15*a,b* may be annular members, disposed around the mandrel, and longitudinally coupled thereto by a threaded connection. The caps 15*a,b* may also be disposed about a shoulder formed in or disposed on an outer surface of the mandrel 3. Seals, such as o-rings, may be disposed between the caps 15*a,b* and the mandrel 3 and between the caps 15*a,b* and the sleeves 12,13.

An end 12*a* of the sleeve 12 may be exposed to an exterior of the setting tool 1. The end 12*a* of the sleeve 12 may further include a profile formed therein or fastened thereto by a threaded connection. The profile may mate with a corresponding profile formed on an outer surface of the ratchet assembly 18, thereby longitudinally coupling the ratchet 18 and the sleeve 12 when the pistons are actuated. The sleeve profile may engage the ratchet profile by compressing a spring, such as a c-ring. The c-ring may then expand to lock in a groove of the sleeve profile. Teeth formed on inner and outer surfaces of a lock ring of the ratchet assembly 18 respectively engage corresponding teeth formed on an outer surface of the mandrel 3 and an inner surface of a ring housing, thereby longitudinally locking the sleeve 12 and thus the expander assembly 25 once the sleeve 12 engages the ratchet assembly 18.

The outlet 17*a* may be formed through an outer surface of the piston 11*a* and may provide fluid communication between a second side of the piston 11*a* and the exterior of the setting tool 1. The sleeves 13,14 may be longitudinally coupled to the piston 11*b* by a threaded connection. The outlet 17*b* may be formed through a wall of the sleeve 14 and may provide fluid communication between a second side of the piston 11*b* and the exterior of the setting tool 1. An end 14*a* of the sleeve 14 may be longitudinally coupled to an expander assembly 25 by a threaded connection and one or more set screws. The sleeve 14 may also be temporarily longitudinally coupled to the mandrel at 14*b* by one or more frangible members, such as shear screws.

The expander assembly 25 may include a body 26, upper cone retainer 27, a plurality of cones 28*a,b*, cone base 29, lower cone retainer 30, sleeve 31, and shoe 32, pusher 33, and one or more frangible members, such as shear screws 34. The expander assembly 25 may be operable to radially and plastically expand the hanger 105 into engagement with a previously installed liner or casing. The expander assembly 25 may be driven through the expandable hanger 105 by the pistons 11*a,b*. The pusher 33 may longitudinally coupled to the sleeve 14 by a threaded connection and one or more fasteners, such as set screws. The pusher 33 may be longitudinally coupled to the body 26 by the shear screws 34. The cones 28*a,b* may each include a lip at each end thereof in engagement with respective lips formed at a bottom of the upper retainer 27 and a top of the lower retainer 30, thereby radially coupling the cones to the retainers. An inner surface of each cone may be inclined for mating with an inclined outer surface of the cone base 29, thereby holding each cone radially outward into engagement with the retainers.

The body 26 may be tubular, disposed along the mandrel 3, and longitudinally movable relative to the mandrel. The upper retainer 27 may be longitudinally coupled to the body 26 by a threaded connection and one or more fasteners, such as set screws. The retainers, sleeve, and shoe may be disposed along the body. The upper retainer 27 may abut the cone base 29 and the cones 28*a,b*. The cones may abut the lower retainer 30. The lower retainer 30 may abut the sleeve 31 and the sleeve 31 may abut the shoe 32. The shoe 32 may be longitudinally coupled to the body 26 by a threaded connection and one or more fasteners, such as set screws.

In operation (see FIG. 3C), movement of the sleeve 14 longitudinally toward the upper retainer 27 may fracture the shear screws 34 since the body 26 may be retained by engagement of the cones 28*a,b* with a top of the liner hanger 105. Failure of the shear screws 34 may free the pusher 33 for relative longitudinal movement toward the upper retainer until a bottom of the pusher abuts a top of the upper retainer. Continued movement of the sleeve 14 may then push the cones 28*a,b* through the liner hanger 105, thereby expanding the liner hanger 105 into engagement with the previously installed casing/liner 305. When removing the setting tool 1 (FIG. 3D), a top of the override 59 may engage a bottom of the body 26, thereby carrying the expander assembly 25 with the mandrel 3.

The expandable liner hanger 105 may include a tubular body made from a ductile material, such as a metal or alloy, such as steel or stainless steel. The hanger may include one or more seals 105*a* disposed around an outer surface of the body. The seals 105*a* may be made from a soft material, such as lead or a polymer, such as an elastomer. The hanger may have teeth 105*b* embedded in the one or more of the seals 105*a* for engaging an inner surface of the previously installed casing/liner and/or supporting the seals 105*a*. Alternatively, a hard material 705*b* (see FIG. 7) may be disposed along an outer surface of the hanger and/or the seals 105*a* to penetrate an inner surface of the previously installed casing or liner, thereby securing the hanger 105 to the casing or liner. The hard material may be a ceramic, such as a carbide, such as tungsten carbide and disposed on the seals as dust and/or disposed on the hanger as teeth or blades.

The liner assembly 100 may be longitudinally and rotationally coupled to the mandrel 3 by the latch assembly 50. The latch assembly 50 may include a piston 51, a stop 52, a release 53, a collet 54, a cap 55, a retainer 56, a biasing member, such as a spring 57, one or more frangible members, such as shear screws 58, an override 59, a body 60, one or more fasteners 61*a,b*, and a catch 62. Alternatively, the latch assembly 50 may include dogs (see dogs 77) instead of a collet.

The override 59 and the body 60 may each be tubular, have a bore therethrough, and include a threaded coupling at each end. The override 59 may be longitudinally and rotationally coupled to the mandrel 3 by one of the threaded couplings at a top thereof and one or more fasteners, such as set screws, and longitudinally and rotationally coupled to the body 60 by one of the threaded couplings and one or more fasteners, such as set screws 61*a*. The body 60 may be longitudinally coupled to a seat 95 by one of the threaded couplings at a bottom thereof. Seals, such as o-rings, may be disposed between the override 59 and the mandrel 3, between the override and the body 60, and between the body and the seat 95. The release 53 may be longitudinally and rotationally coupled to the override 59 by a threaded connection and one or more frangible members (not shown), such as shear screws. The threaded connection may be oppositely oriented (i.e. left-hand) relative to other threaded connections of the setting tool 1. The release 53 may be longitudinally biased away from the override 59 by engagement of the spring 57 with fasteners 61*b*.

The collet 54 may have a plurality of fingers each having a profile formed at a bottom thereof. The fingers 54*f* may engage a corresponding profile formed in an inner surface of the adapter 115. The collet 54, case 56, and cap 55 may be longitudinally movable relative to the body 60 between the stop 52 and a top of the piston 51. When weight of the liner assembly 100 is applied to the collet 54, the collet may move downward along the body 60 until the fingers seat against a profile 95*a* formed in a top of the seat 95, thereby longitudinally coupling the liner assembly 100 to the setting tool 1. Keys 53*k* and keyways may be formed in an outer surface of the release 53. The keys 53*k* and keyways may engage respective keyways and keys 115*k* formed in a top of the adapter 115, thereby rotationally coupling the liner assembly 100 and the setting tool 1.

The piston 51 may be fluidly operable to release the fingers 54*f* when actuated by a predetermined pressure. The piston 51 may be longitudinally coupled to the body 60 by the shear screws 58. Once the liner hanger 105 has been expanded into engagement with the casing/liner 305 (see FIG. 3C) and weight of the liner assembly is supported by the liner hanger 105 and/or setting the liner 125 onto a bottom of the wellbore 300, fluid pressure may be increased. The fluid pressure may push the piston 51 and fracture the shear screws 58, thereby releasing the piston 51. The piston 51 may then move upward toward the collet 51 until the piston 51 abuts a bottom of the collet 54. The piston 51 may continue upward movement while carrying the collet 54 (and fingers 54*f*), case 56, and cap 55 upward until a bottom of the release abuts the fingers 54*f*, thereby pushing the fingers 54*f* radially inward. The catch 62 may be a split ring biased radially inward and disposed between the collet 54 and the case 56. The body 60 may include a recess formed in an outer surface thereof. During upward movement of the piston 51 and members 54-56, the catch 62 may align and enter the recess, thereby forming a downward stop preventing reengagement of the fingers 54*f*. Movement of the piston and members 54-56 may continue until the cap 55 abuts the stop 52, thereby ensuring complete disengagement of the fingers 54*f*.

In the event that the liner assembly 100 becomes stuck in the wellbore 300 during run-in, the override 59 may be operated to release the fingers 54*f* from the liner assembly 100. The override 59 may be operated by setting down weight of the run-in string 685 onto the liner assembly 100, thereby moving the collet 54 upward along the body 60 and the fingers 54*f* from engagement with the profile 95*a*. The run-in string may then be rotated, thereby rotating the override, fracturing the shear screws, and freeing the release from the override. The spring 57 may then move the release 53 toward the fingers 54*f* until the release 53 disengages the fingers 54*f* from the adapter.

The seal assembly 75 may include a lock 76, a plurality of dogs 77, dog retainer 78, a cap 79, fasteners, such as screws 80, a catch 81, a body 82 and one or more seal stacks 83*a,b*. Each of the seal stacks 83*a,b* may include first and second end adapters (not shown), one or more first seals (not shown), a center adapter (not shown), and one or more second seals (not shown). The first seals may be directional (i.e., chevron rings), and may be disposed between the first end adapter and the center adapter. The second seals may be directional and disposed between the center adapter and the second end adapter with an orientation opposing the first seals. The body 82 may be tubular, have a bore therethrough, and include a threaded coupling at each end. The body 82 may be longitudinally coupled to the housing 214 by one of the threaded couplings at a top thereof and longitudinally coupled to the catch 81 by one of the threaded couplings and one or more fasteners, such as set screws. A seal, such as an O-ring, may be disposed between the body 82 and the catch 81. The dogs 77 may be radially movable between an extended position and a retracted position. The dogs 77 may be disposed in respective recesses formed in the dog retainer 78 and a lip of each dog may engage a respective lip of the retainer 78 in the extended position, thereby keeping the dogs 77 disposed in the recesses.

The dogs 77 may be held in the extended position by abutment of protrusions of a profile formed in an inner surface of the dog with respective protrusions of a profile formed in an outer surface of the lock 76. The dogs 77 may engage a groove formed in an inner surface of the adapter 115 in the extended position, thereby longitudinally coupling the dogs and the adapter. Each screw 80 may be received by a threaded opening formed through the retainer 78. An end of each screw 80 may extend into a respective slot formed through the lock 76, thereby coupling the lock and the retainer while allowing limited longitudinal movement therebetween. The cap 79 may be longitudinally coupled to the block retainer 78 by a threaded connection. Inner seal stack 83*a* may be disposed radially between the dog retainer and the body and longitudinally between a lower surface of the cap and a shoulder formed in the dog retainer. Outer seal stack 83*b* may be disposed radially between the dog retainer and the adapter 115 and longitudinally between a bottom of the cap and a shoulder formed in the dog retainer. The seal stacks 83*a,b* may fluidly isolate a bore of the liner 125 from an annulus formed between the setting tool 1 and the rest of the liner assembly 100.

To release the lock 76 (see FIG. 3D), the body 82 may be moved upward carrying the catch 81 toward the lock 76 until a top of the catch 81 abuts a bottom of the lock and pushes the lock 76 upward toward the dog retainer 78 until recesses in the lock profile align with protrusions in the dog profile. A lower portion of the body 82 may include one or more grooves formed in an outer surface thereof for pressure equalization as the catch moves toward the lock. Alignment of the profiles allows the dogs to move from the extended position to the retracted position, thereby freeing the dogs from the adapter 115.

The setting tool 1 may further include the seat 95. The seat 95 may have a tapered inner surface 95*s* for receiving a ball or plug (not shown) and one or more ports 95*p* formed radially therethrough. The ports 95*p* may be isolated from the setting tool-adapter annulus by seals, such as O-rings, disposed between the seat and the adapter 115 and longitudinally straddling the ports 95*p*. The ball or plug may be deployed as a safeguard or in response to failure of the isolation valve 200. The ball may be released from the surface a predetermined distance behind the top plug (se FIG. 3A) so that the ball may be substantially pumped to the seat 95 by the displacement fluid (the ball may have to free fall a small depth once the top plug has seated against the wiper). Alternatively, should the isolation valve 200 fail, a plug may be delivered to the seat via wireline (not shown) or the ball may be deployed after the top plug has seated by free-falling to the seat 95. As with the isolation valve 200, landing of the ball or plug may fluidly isolate the mandrel bore from the liner bore. When the setting tool is being removed from the liner assembly 100 and the seat is removed from the liner assembly, the port seals may no longer engage a sealing surface due to the larger inside diameter of the previously installed casing or liner, thereby opening the ports 95*p*. The ports 95*p* may then provide fluid communication between the setting tool bore and the wellbore, allowing drainage of the displacement fluid from the setting tool 1 and the run-in string 685 as the setting tool 1 travels to the surface. A bottom of the seat 95 may be longitudinally coupled to the housing 201 by a threaded connection.

The wiper assembly 150 may include a body 151, a wiper 152, and one or more frangible members, such as shear screws 153. The body 151 may be longitudinally coupled to the catch 81 by the shear screws 153. The body 151 may be tubular and have a profile 151*p* formed along an inner surface thereof for receiving a top plug 320 (see FIG. 3A). The top plug 320 may include a latch for engaging the profile 151*p*. Additionally, the wiper assembly 150 may be a top wiper assembly and the setting tool may further include a bottom wiper assembly (not shown). The bottom wiper assembly may be longitudinally coupled to the body 151 by shear screws and have an inner diameter less than an inner diameter of the top wiper assembly 150. In this manner a bottom plug (not shown) may be deployed before the cement is pumped for isolating the cement from circulation fluid and may be pumped through the body 151 and seat in the bottom wiper assembly. The bottom plug may include a diaphragm or valve.

Figure 2B:
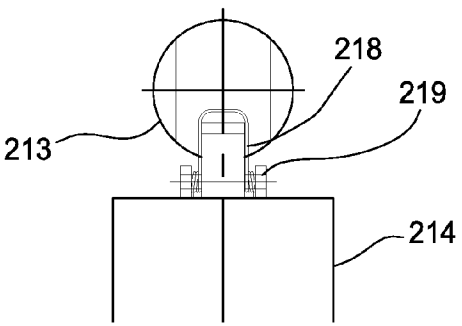
FIG. 2B illustrates a flapper of the isolation valve.
Figure 2A:
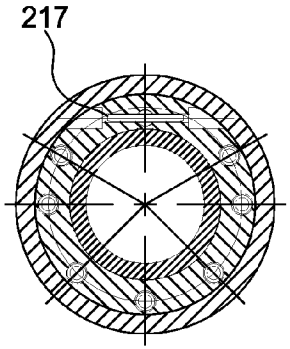
FIG. 2A illustrates a coupling between a piston and retaining rod of the isolation valve.
Figure 2:
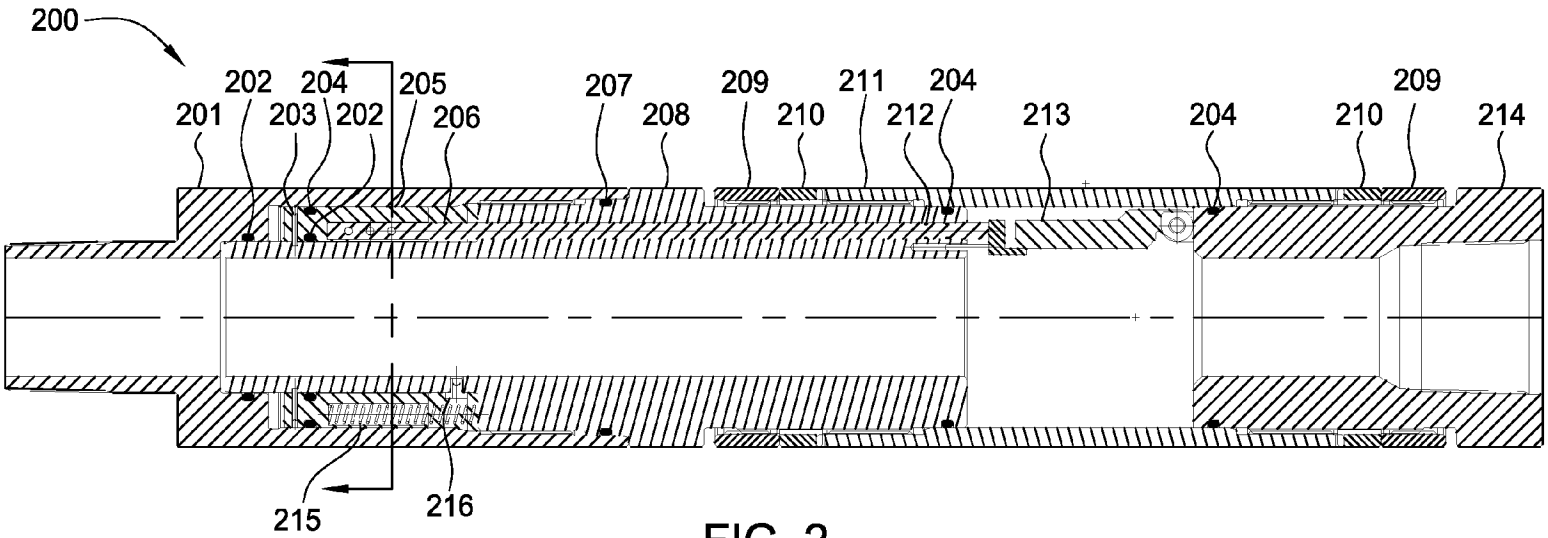
FIG. 2 is a cross-section of an isolation valve of the setting tool.

FIG. 2 is a cross-section of the isolation valve 200. The isolation valve may be longitudinally coupled to the mandrel 3 by a threaded connection. The isolation valve may include one or more housings 201,208,211,214, one or more seals, such as o-rings 202,204,207,212, one or more frangible members, such as shear screws 203 and rupture disk 216, a piston 205, a retaining rod 206, one or more nuts 209, one or more locator rings 210, a valve member such as a flapper 213, and one or more biasing members, such as springs 215,218, and one or pins 217, 219. Alternatively, the valve member may be a ball (not shown).

The piston 205 may be longitudinally coupled to the flapper 213 via the retaining rod 206. The piston 205 may be longitudinally coupled to the retaining rod 206 via the pins 217. The piston 205 may be biased away from the flapper 213 by spring 215 and longitudinally and rotationally coupled to the housing 208 by shear screws 213. The retaining rod 206 may hold the flapper 213 in the open position. The flapper 213 may be biased towards the closed position by the spring 218 disposed on a mount, such as the pin 219. A chamber housing the piston 205 and the spring 215 may be sealed at the surface with air at atmospheric pressure. In operation, when it is desired to close the flapper 213, pressure may be increased in bores of the housings 201,208,211,214 until a predetermined pressure is reached. The rupture disk 216 may then fracture, thereby providing fluid communication between the housing bores and a bottom of the piston 205. The resulting fluid force may fracture the shear screws 203 and (along with the spring 215) move the piston 205 away from the flapper 213, thereby allowing the flapper 213 to close.

FIGS. 3A-D illustrate installation of the liner assembly 100. In operation, the setting tool 1, liner assembly 100, and wiper assembly 150 may be run into the wellbore 300 until the liner hanger 105 overlaps an end of the previously installed casing or liner 305 distal from the surface. A bottom of the liner 125 may or may not rest on a bottom of the wellbore. Prior to run-in, fluid, such as drilling mud, may be circulated to ensure that all of the cuttings have been removed from the wellbore. A surge reduction valve (not shown), if used, may be closed. Circulation may then be established by pumping fluid, such as drilling mud, down the run-in string and up the liner annulus. The liner assembly 100 may be reciprocated and/or rotated during circulation. If auto-fill equipment (not shown) is used, it may be released. If a bottom wiper assembly (not shown) is used, then the bottom plug may be launched.

Cement slurry 315 may then be pumped from the surface into the run-in string. The liner assembly 100 may be reciprocated and/or rotated during injection of the cement. A spacer fluid (not shown) may be pumped in ahead of the cement 315. Once a predetermined quantity of cement 315 has been pumped, a top plug 320 may be pumped down the run-in string using a displacement fluid 310, such as drilling mud. The bottom plug may seat in the bottom wiper assembly, free the bottom wiper assembly from the setting tool, and land in the float collar/shoe. The diaphragm may then rupture or the valve may open due to a density differential between the cement and the circulation fluid and/or increased pressure from the surface.

Figure 3A:
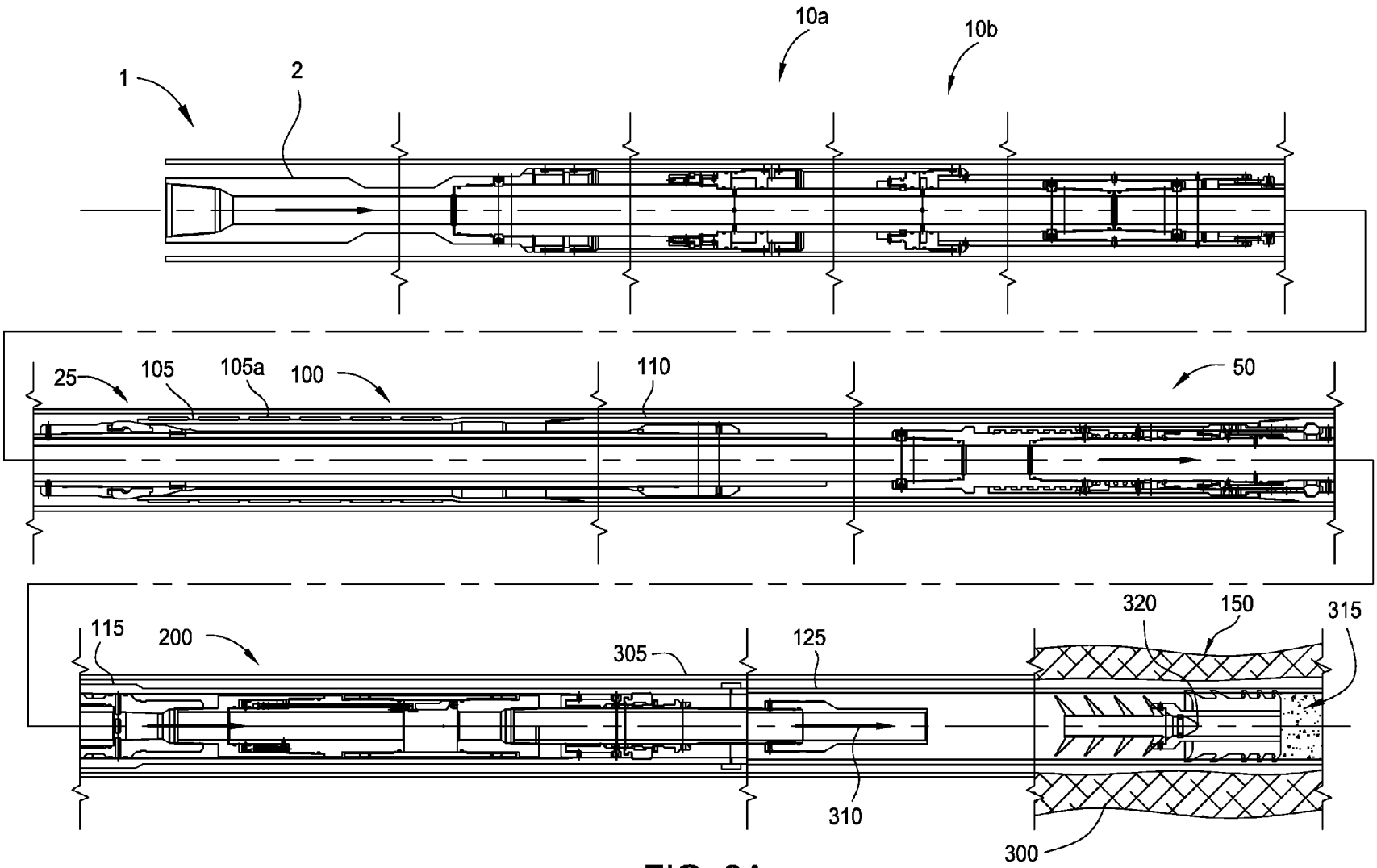
FIGS. 3A-D illustrate installation of the liner assembly.

Pumping of the displacement fluid 310 may continue and the top plug 320 may seat in the wiper body 151, thereby closing the bore through the wiper body 151 (FIG. 3A). The displacement fluid 310 may have a density substantially less than the density of the cement, thereby placing the liner 125 in compression. A latch of the plug 320 may engage the profile 151*p* and hydraulic pressure may fracture the shear screws 153, thereby freeing the wiper assembly 150 and the plug 320. The wiper/plug 150, 320 may then be pumped down the liner 125, thereby forcing the cement 315 through the liner and out into the liner annulus. Pumping may continue until the wiper/plug 150, 320 seat against a landing or float collar (not shown), thereby indicating that the cement 315 is in place in the liner annulus.

Figure 3B:
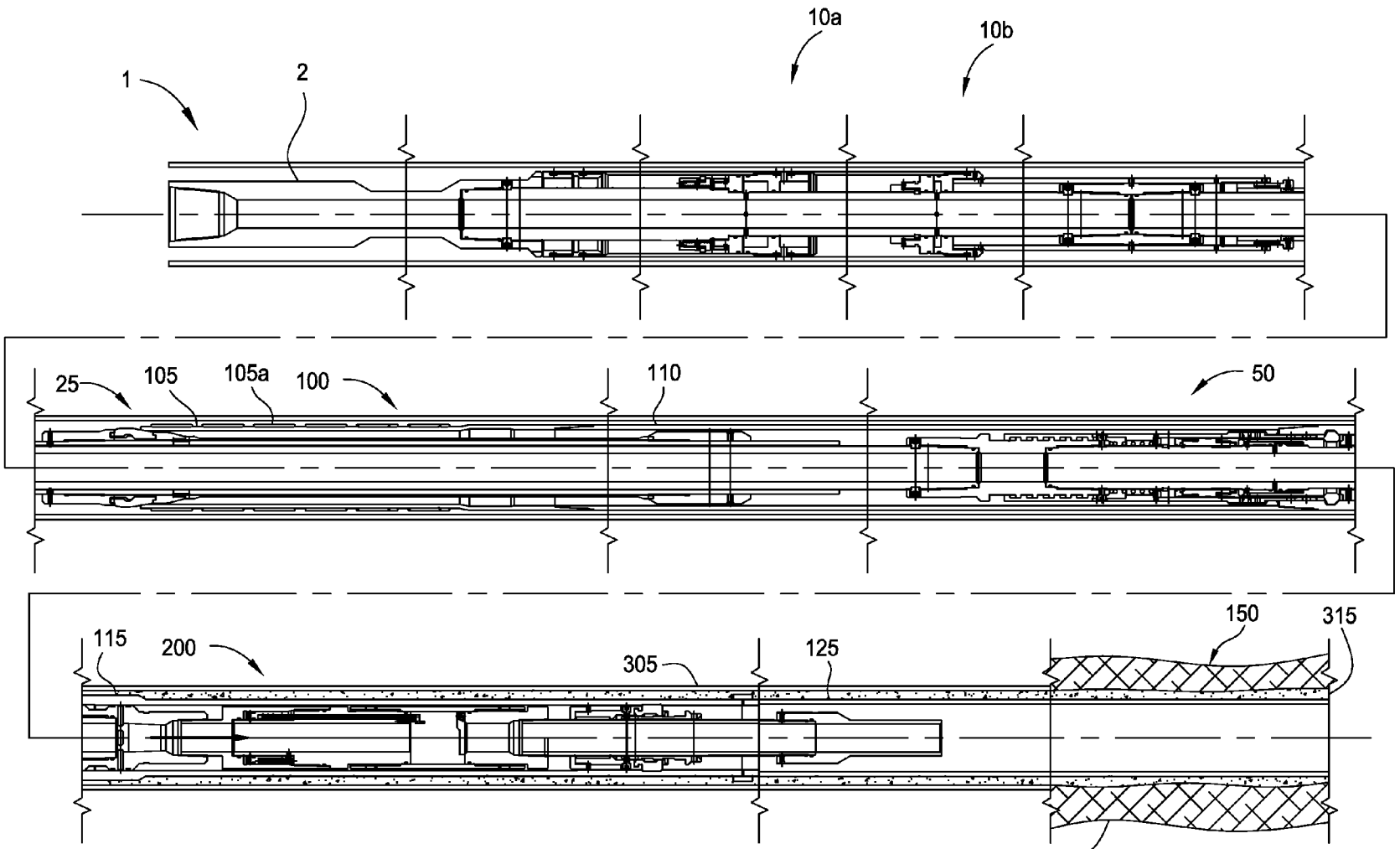
Figure 3C:
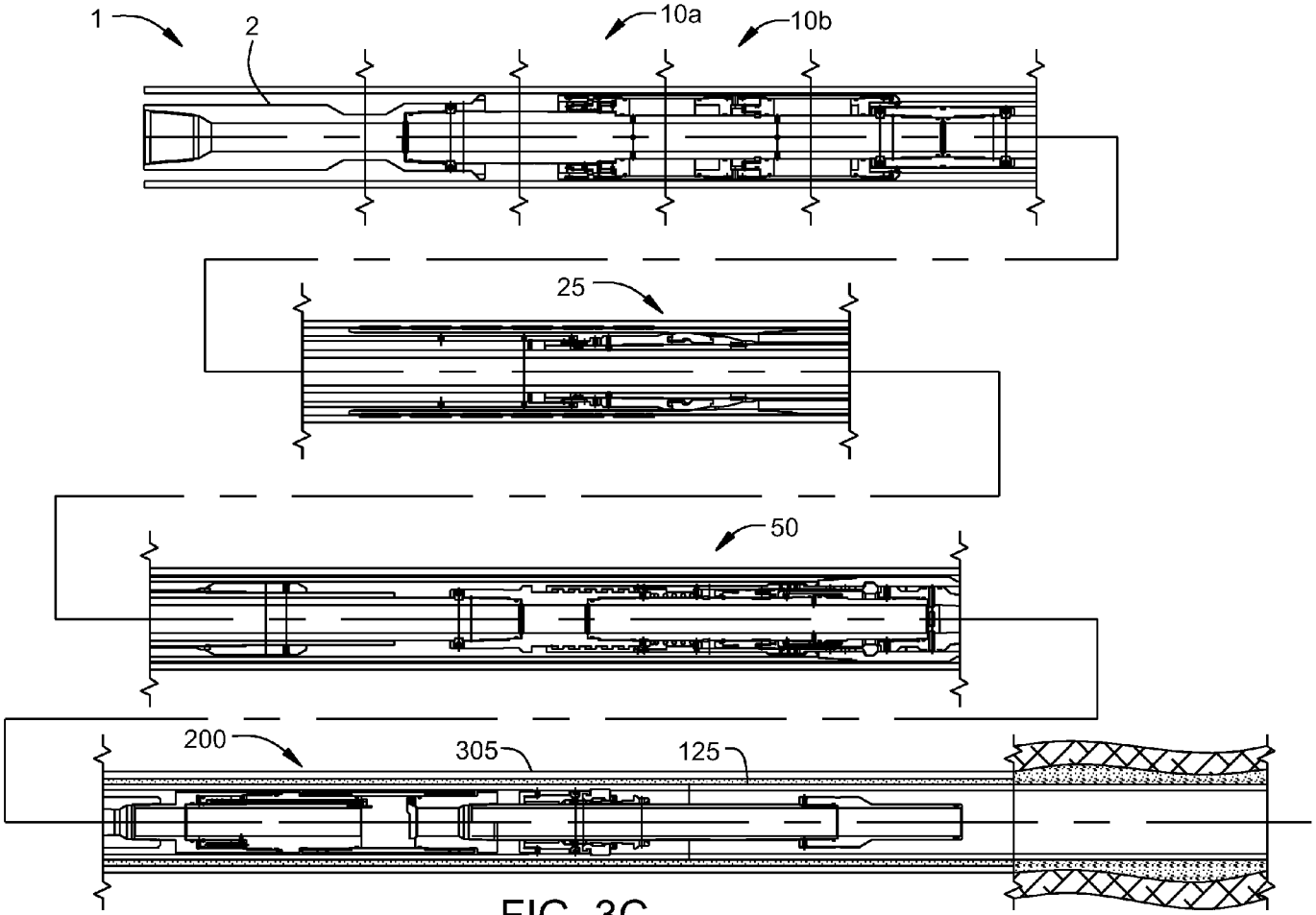
Figure 3D:
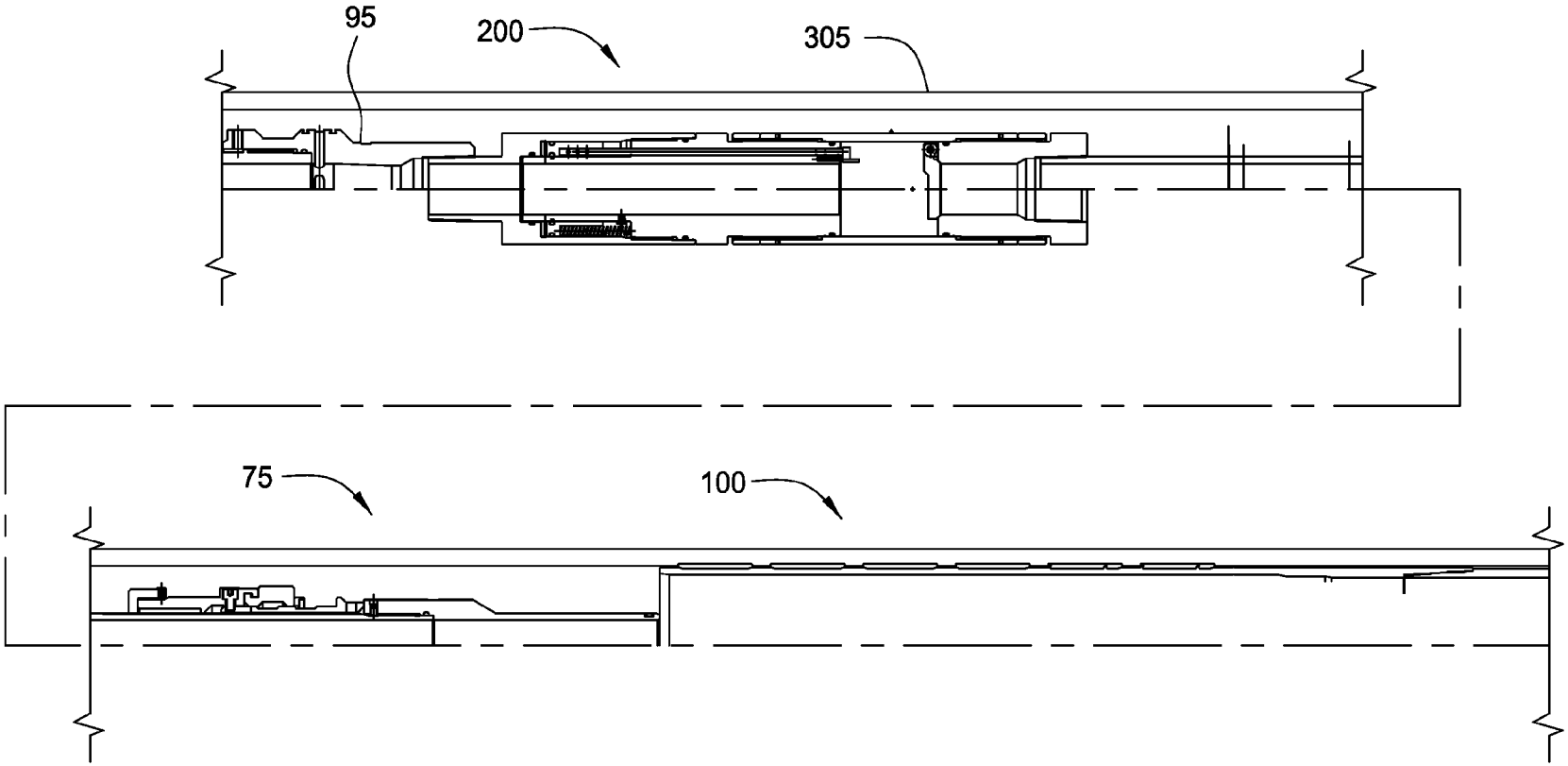

The pressure may then be increased until the rupture disk 216 in the isolation valve 200 fractures, thereby moving the piston 205 and allowing the flapper 213 to close (FIG. 3B). The flapper 213 may isolate the mandrel bore from the liner bore. Pressure may then be increased to fracture the shear screws 14*b* and operate the pistons 11*a,b*, thereby pushing the expander assembly 25 through the expandable liner hanger 105 (FIG. 3C). Once the hanger 105 is expanded into engagement with the previously installed casing or liner 305, the latch assembly 50 may be released from the liner assembly 105 and the setting tool 1 removed (FIG. 3D). Before retrieval to the surface, the setting tool 1 may be raised and fluid, such as drilling mud, may be reverse circulated (not shown) to remove excess cement above the hanger before the cement sets.

Figure 4:
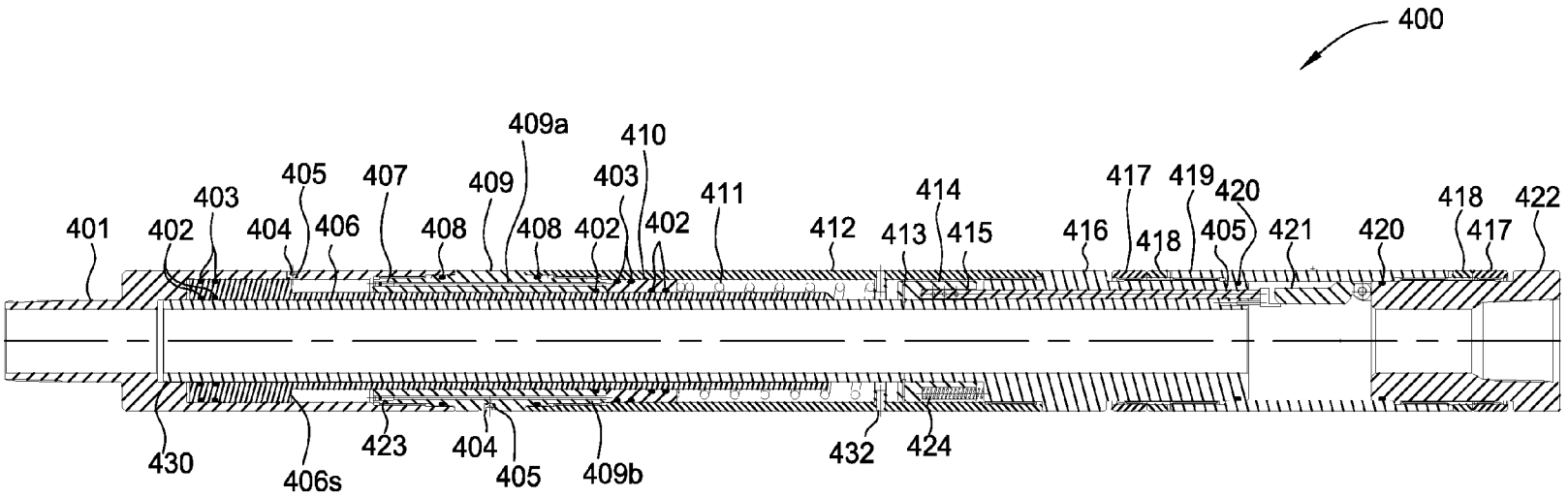
FIG. 4 is a cross-section of an isolation valve, according to another embodiment of the present invention.

FIG. 4 is a cross-section of an isolation valve 400, according to another embodiment of the present invention. The isolation valve 400 may be used instead of the isolation valve 200. The isolation valve 400 may include one or more housings 401,409,412,416,419,422, one or more seals, such as o-rings 402,403,405,408,420, one or more plugs 404, one or more frangible members, such as shear screws 413, one or more pistons 406,410, an actuator 414, a retaining rod 415, a choke 407, one or more nuts 417, one or more locator rings 418, a valve member, such as a flapper 421, and one or more biasing members, such as springs 411,424, and 218 (see FIG. 2B), one or more check valves 423, and one or pins 217, 219 (see FIGS. 2A and 2B).

A top of the piston 405 may be in fluid communication with a bore of the housings 401, 416 via fluid path 430 defined between the housings 401, 416. A chamber housing spring 411 may be in fluid communication with the liner annulus via vent 432. A hydraulic fluid, such as oil, may be disposed between a shoulder 406*s* of the piston 406 and a top of the piston 410. The housing 409 may include fluid ports 409*a,b* longitudinally formed therethrough. The fluid ports 409*a,b* may provide limited fluid communication between an upper hydraulic chamber formed between the shoulder 406*s* and a top of the housing 409 and a lower hydraulic chamber formed between a bottom of the housing 409 and the top of the piston 410.

The check valve 423 may be disposed in the path 409*b* and operable to prevent flow of the hydraulic fluid from the upper hydraulic chamber to the lower hydraulic chamber and allow flow from the lower hydraulic chamber to the upper hydraulic chamber. The choke 407 may be disposed in the path 409*a* and operable to restrict hydraulic flow from the upper hydraulic chamber to the lower hydraulic chamber. The choke 407 may also restrict flow from the lower hydraulic chamber to the upper hydraulic chamber but this restriction may be negated by the open check valve 423. The piston 410 may be longitudinally coupled to the piston 406 by incompressibility of the hydraulic fluid. A bottom of the piston 410 may be in fluid communication with the liner annulus via the vent 432. The piston 410 may be biased toward the housing 409 by the spring 411.

The actuator 414 may be longitudinally coupled to the flapper 421 via the retaining rod 415. The actuator 414 may be longitudinally coupled to the retaining rod 415 via the pins 217. The retaining rod 415 may hold the flapper 421 in the open position. The flapper 421 may be biased towards the closed position by the spring 218 disposed on a mount, such as the pin 219. The actuator 414 may be longitudinally coupled to the housing 416 by the shear screws 413.

Figure 4A:
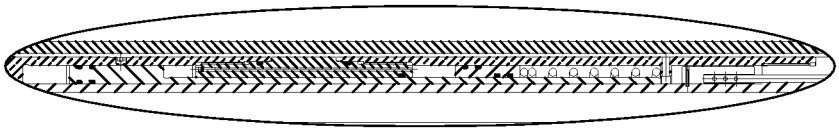
FIGS. 4A-C illustrate operation of the isolation valve.
Figure 4B:
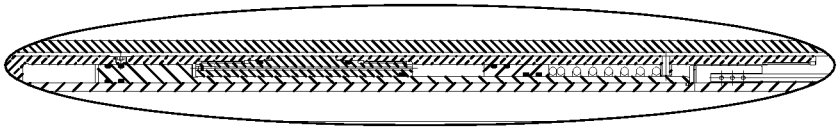
Figure 4C:
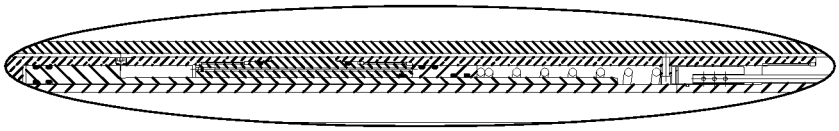

FIGS. 4A-C illustrate operation of the isolation valve 400. Once pressure in the bore of the housings 401, 416 exceeds pressure in the liner annulus by an amount sufficient to overcome the bias of the spring 411 (threshold pressure), the piston 406 begins to move longitudinally downward toward the housing 409 (FIG. 4A). Since movement of the piston is dampened by the choke 407, the increased pressure must be sustained for a predetermined period of time, else once the pressure is reduced, the biasing member will return the piston 406 to the position of FIG. 4A. Once sustained threshold pressure has been applied to the top of the piston 406, a bottom of the piston 406 abuts a top of the actuator 414 and fractures the shear screws 413 (FIG. 4B). Pressure may be then reduced to the annulus pressure or relieved at the surface, thereby allowing the spring 411 to return the piston 406 to the position of FIG. 4A. The spring 424 may then longitudinally move the actuator 414 and retaining rod 420 longitudinally upward away from the flapper 421, thereby releasing the flapper and allowing the spring 218 to close the flapper (FIG. 4C).

The choke 407 may time the movement of the piston 406 so that threshold pressure must be sustained for the piston to reach the actuator 414. For example, when running the liner assembly 100 into the wellbore, a surge pressure may exceed the threshold pressure but may not be sustained to fully move the piston 406. However, once the top plug 320 seats against the wiper 315, then the threshold pressure may be applied for the sustained period. If pressure is relieved from the run-in string at the surface, the flapper 421 may allow annulus pressure to also be relieved. However, once pressure is reapplied to set the liner hanger 105, the flapper 421 will close and isolate the liner 125 from setting pressure applied to the setting tool 1.

Figure 4D:
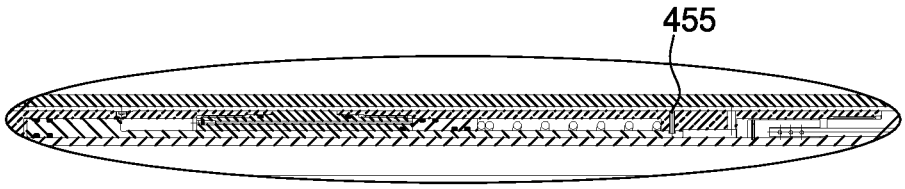
FIG. 4D illustrates an alternative embodiment of the isolation valve.

FIG. 4D illustrates an alternative embodiment of the isolation valve 400. In this alternative, the piston 406 is initially longitudinally restrained by one or more frangible members, such as shear pins 455. The shear pins 455 may keep the piston 406 from moving until a predetermined pressure has been reached. The shear pins 455 may avoid unintentional operation of the piston 406 during circulation and cementing operations.

Figure 5:
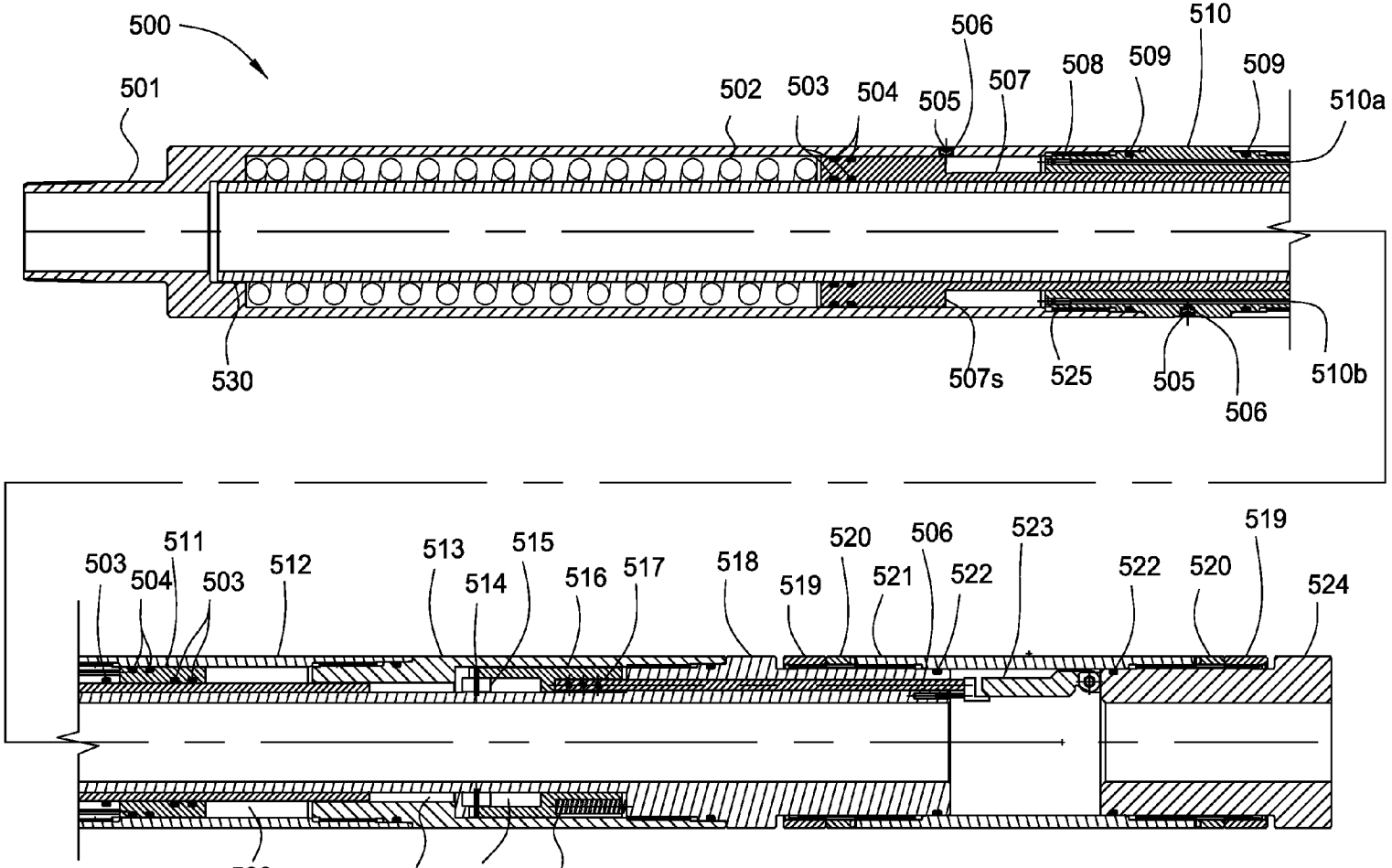
FIG. 5 is a cross-section of an isolation valve, according to another embodiment of the present invention.

FIG. 5 is a cross-section of an isolation valve 500, according to another embodiment of the present invention. The isolation valve 500 may be used instead of the isolation valve 200. The isolation valve may include one or more housings 501,510,512,513,518,521,524 one or more seals, such as o-rings 503,504,506,509,522 one or more plugs 505, one or more frangible members, such as shear screws 514, one or more pistons 507,511, an actuator 515,516, a retaining rod 517, a choke 508, one or more nuts 519, one or more locator rings 520, a valve member such as a flapper 523, and one or more biasing members, such as springs 502,526, and 218 (see FIG. 2B), one or more check valves 525, and one or pins 217, 219 of (see FIGS. 2A and 2B). In operation, the spring 502 is used to slowly engage a release mechanism so the running of the liner and cementing of the liner can be completed before the valve closes.

The actuator may include a head 516 and a ring 515. The head 516 and the ring 515 may be longitudinally and rotationally coupled to the housing 518 by the shear screws 514. The head 516 may be longitudinally coupled to the flapper 523 via the retaining rod 517. The head 516 may be biased away from the flapper 523 by the spring 526. The head 516 may be longitudinally coupled to the retaining rod 517 via the pins 217. The retaining rod 517 may hold the flapper 523 in the open position. The flapper 523 may be biased towards the closed position by the spring 218 disposed on a mount, such as the pin 219.

A top of the piston 507 may be in fluid communication with a bore of the housings 501, 518 via fluid path 530 defined between the housings 501, 518. A hydraulic fluid, such as oil, may be disposed between a shoulder 507*s* of the piston 507 and a top of the piston 511. The housing 510 may include fluid ports 510*a,b* longitudinally formed therethrough. The fluid ports 510*a,b* may provide limited fluid communication between an upper hydraulic chamber formed between the shoulder 507*s* and a top of the housing 510 and a lower hydraulic chamber formed between a bottom of the housing 510 and the top of the piston 511.

The check valve 525 may be disposed in the path 510*b* and operable to prevent flow of the hydraulic fluid from the upper hydraulic chamber to the lower hydraulic chamber and allow flow from the lower hydraulic chamber to the upper hydraulic chamber. The choke 508 may be disposed in the path 510*a* and operable to restrict hydraulic flow from the upper hydraulic chamber to the lower hydraulic chamber. The choke 510*a* may also restrict flow from the lower hydraulic chamber to the upper hydraulic chamber but this restriction may be negated by the open check valve 525. The piston 511 may be longitudinally coupled to the piston 507 by incompressibility of the hydraulic fluid. The piston 507 may be biased longitudinally downward toward the housing 510 by the spring 502. A chamber 535 between the housing 518 and the head 516, a chamber 537 between the housings 513, 518, and a chamber 539 between the housing 512 and the piston 507 may be sealed at the surface with air at atmospheric pressure.

In operation, once the isolation valve 500 is assembled, the spring 502 may begin to move the piston 507 longitudinally downward toward the flapper 523. Since movement of the piston 507 is dampened by the choke 508, the piston 507 may require a predetermined period of time before a bottom of the piston 507 abuts a top of the ring 515 and fractures the shear screws 514. The predetermined period may be selected so the liner assembly 100 may be run into the wellbore and cemented before the flapper 523 closes.

Alternatively, the spring 502 may be omitted and fluid pressure exerted on a top of the piston via flow path 530 may be used to operate the piston 507.

Figure 6:
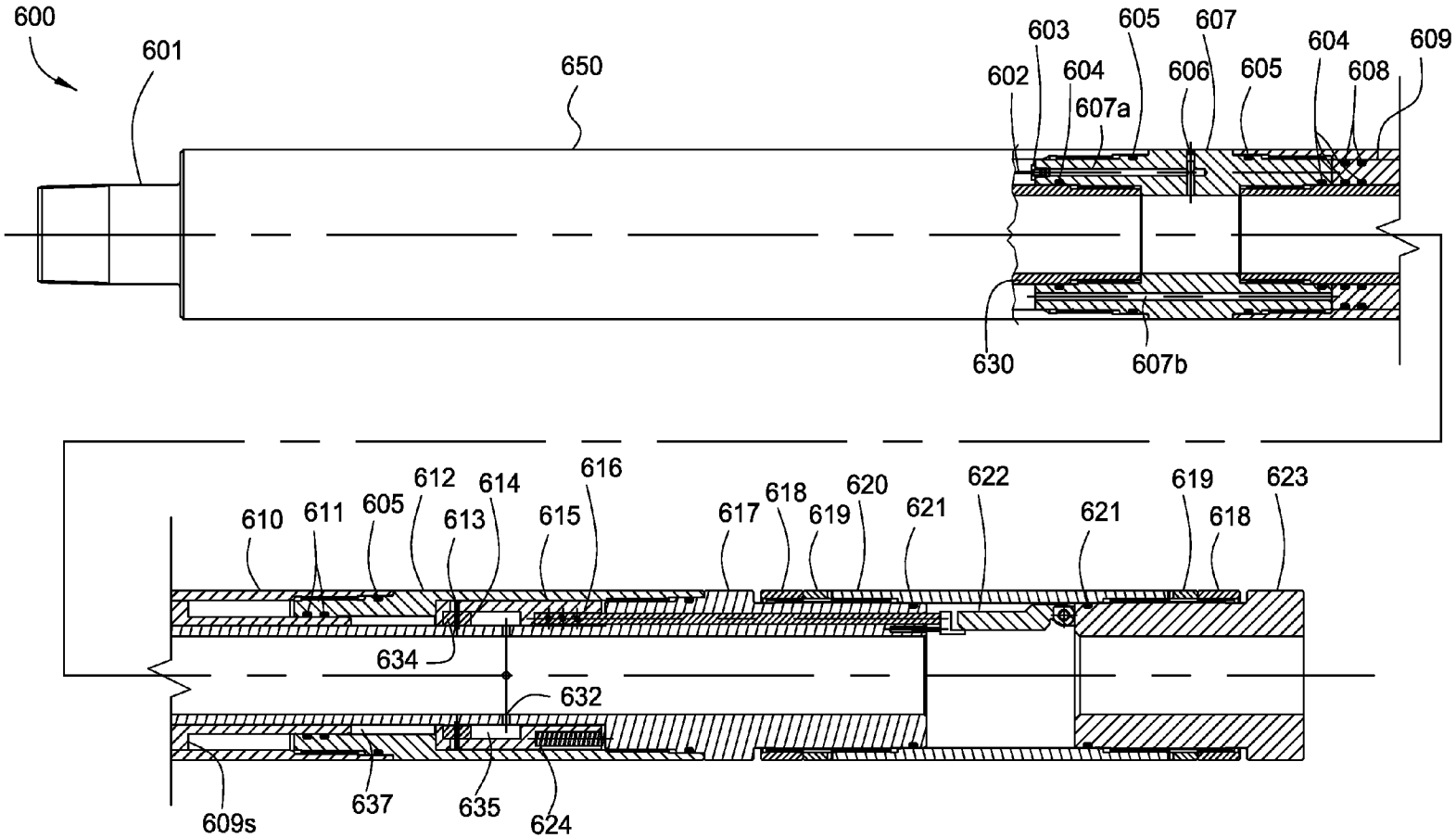
FIG. 6 is a cross-section of an isolation valve, according to another embodiment of the present invention.

FIG. 6 is a cross-section of an isolation valve 600, according to another embodiment of the present invention. The isolation valve 600 may be used instead of the isolation valve 200. The isolation valve 600 may include one or more housings 601,607,610,612,617,620,623,630, a pick 602, one or more seals, such as o-rings 604,605,608,611,621, one or more plugs 606, one or more frangible members, such as shear screws 613 and rupture disk 603, one or more pistons 609, an actuator 614,615, a retaining rod 616, one or more nuts 618, one or more locator rings 619, a valve member such as a flapper 622, one or more biasing members, such as springs 624, 218 (see FIG. 2B), one or pins 217, 219 (see FIGS. 2A and 2B), and an electronics package 650.

The actuator may include a head 615 and a ring 614. The head 615 and the ring 614 may be longitudinally and rotationally coupled to the housing 617 by the shear screws 613. The head 615 may be longitudinally coupled to the flapper 622 via the retaining rod 616. The head 615 may be biased away from the flapper 622 by the spring 624. The head 615 may be longitudinally coupled to the retaining rod 616 via the pins 217. The retaining rod 616 may hold the flapper 622 in the open position. The flapper 622 may be biased towards the closed position by the spring 218 disposed on a mount, such as the pin 219.

An upper chamber between housings 601 and 630, an intermediate chamber between a bottom of the housing 606 and a top of the piston 609, and a lower chamber between a shoulder 609*s* of the piston 609 and a top of the housing 612 may be sealed at the surface with air at atmospheric pressure. The housing 606 may have a first fluid port 606*a* extending radially and longitudinally between a bore therethrough to the upper chamber. The rupture disk 603 may seal the first fluid port 606*a*. The housing 606 may further have a second fluid port 606*b* longitudinally extending therethrough between the upper and intermediate chambers. The housing 617 may have a vent 632 formed radially therethrough providing fluid communication between a bore formed therethrough and a chamber 635 between the housing 617 and the head 615. The chamber 635 may be in fluid communication with a chamber 637 between the housings 612, 617 via flow path 634 formed between ring 614 and housing 617.

Figure 6A:
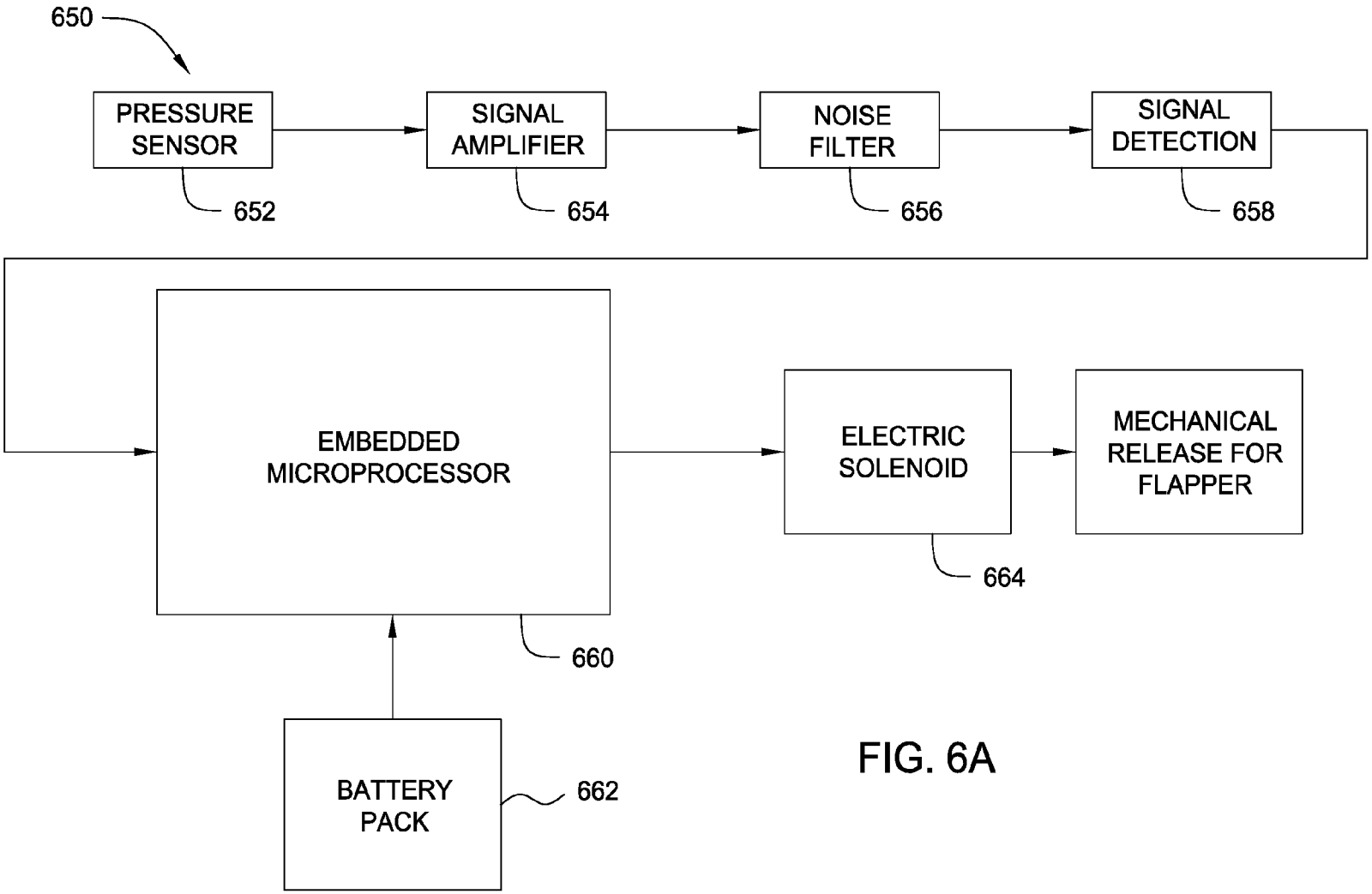
FIG. 6A illustrates an electronics package of the isolation valve.

FIG. 6A illustrates the electronics package 650. The electronics package 650 may include a pressure sensor 652, a signal amplifier 654, a noise filter 656, a signal detector 658, a microprocessor 660, a battery pack 662, and a solenoid 664. Pressure pulses transmitted from the surface to the isolation valve 600 via the run-in string may be transformed by the pressure sensor 652 into an electrical signal. The electrical signal may then be amplified by the signal amplifier 654 and filtered by the noise filter 656. The filtered signal may then be demodulated by the signal detector 658 into a format usable by the microprocessor 660. The demodulated signal may be analyzed by the microprocessor 660 to determine if the signal matches a predetermined instruction signal for closing the flapper 622. If so, then the microprocessor may energize the solenoid, thereby longitudinally moving the pick 602 to fracture the rupture disk 603. The pick 602 may then be retracted from the fractured rupture disk 603 by a spring (not shown) or reversing polarity to the solenoid.

Once the rupture disk 603 has been fractured, circulation fluid from the bore of the isolation valve 600 may flow through the port 607*a* into the upper chamber. Fluid may then flow from the upper chamber through the port 607*b* into the intermediate chamber, thereby moving the piston 609 longitudinally downward toward the flapper 622. Since lower chamber was sealed at the surface, minimal pressure may be exerted on the shoulder 609*s*. The piston 609 may move until a bottom of the piston 609 abuts the ring 614 and fractures the shear screws 613, thereby releasing the head 615. The spring 624 may then move the head 615 (and the rod 616) longitudinally upward away from the flapper 622, thereby releasing the flapper. The spring 218 may then close the flapper 622, thereby fluidly isolating the liner 125 from the setting tool 1. The setting tool 1 may then be operated and the liner hanger 105 expanded.

Figure 6B:
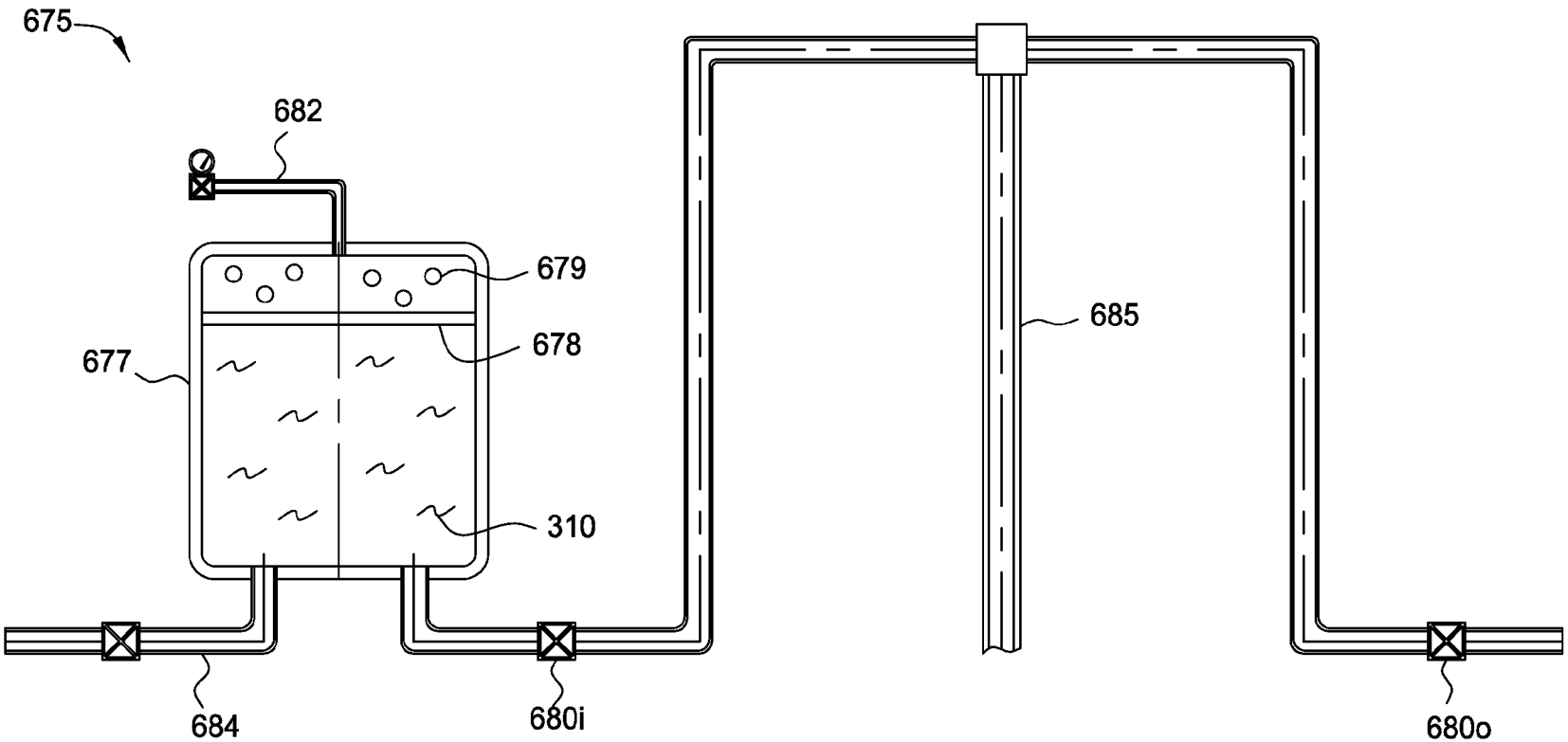
FIG. 6B illustrates surface equipment for generating pressure pulses for the electronics package.

FIG. 6B illustrates surface equipment for generating pressure pulses. The pressure pulses may be generated at the surface using the displacement fluid 310. The displacement fluid 310 may be stored in a surge tank 677. The surge tank 677 may include a fluid barrier, such as a diaphragm 678, separating a chamber of the tank 677 into a displacement fluid chamber and a gas chamber. A fluid line 684 may be in communication with a mud pump of the rig to fill the displacement fluid chamber. A gas line 682 may be in fluid communication with a gas source, such as a portable cylinder, and include a pressure regulator for filling and maintaining the gas chamber at a predetermined pressure. The gas 679 may be nitrogen. The pressure pulses may be applied and released from a bore of the run-in string 685 after the top plug 320 and the wiper 325 have landed in the float or landing collar. The pressure pulses may be generated by opening an inlet control valve, such as a solenoid operated ball valve 680*i*, thereby providing fluid communication between the displacement fluid chamber of the surge tank 677 and the run-in string 685. The valve 680*i* may be electrically, pneumatically, or hydraulically operated. After a predetermined period of time, the valve 680*i* may be closed while opening an outlet control valve 680*o*, thereby relieving fluid pressure from the run-in string to a mud pit or tank (not shown) of the rig. Control of the valves 680*i,o* may be performed by a computer or programmable logic controller (PLC) 690 located at the surface to generate the predetermined instruction signal to close the isolation valve 600.

Figure 6C:
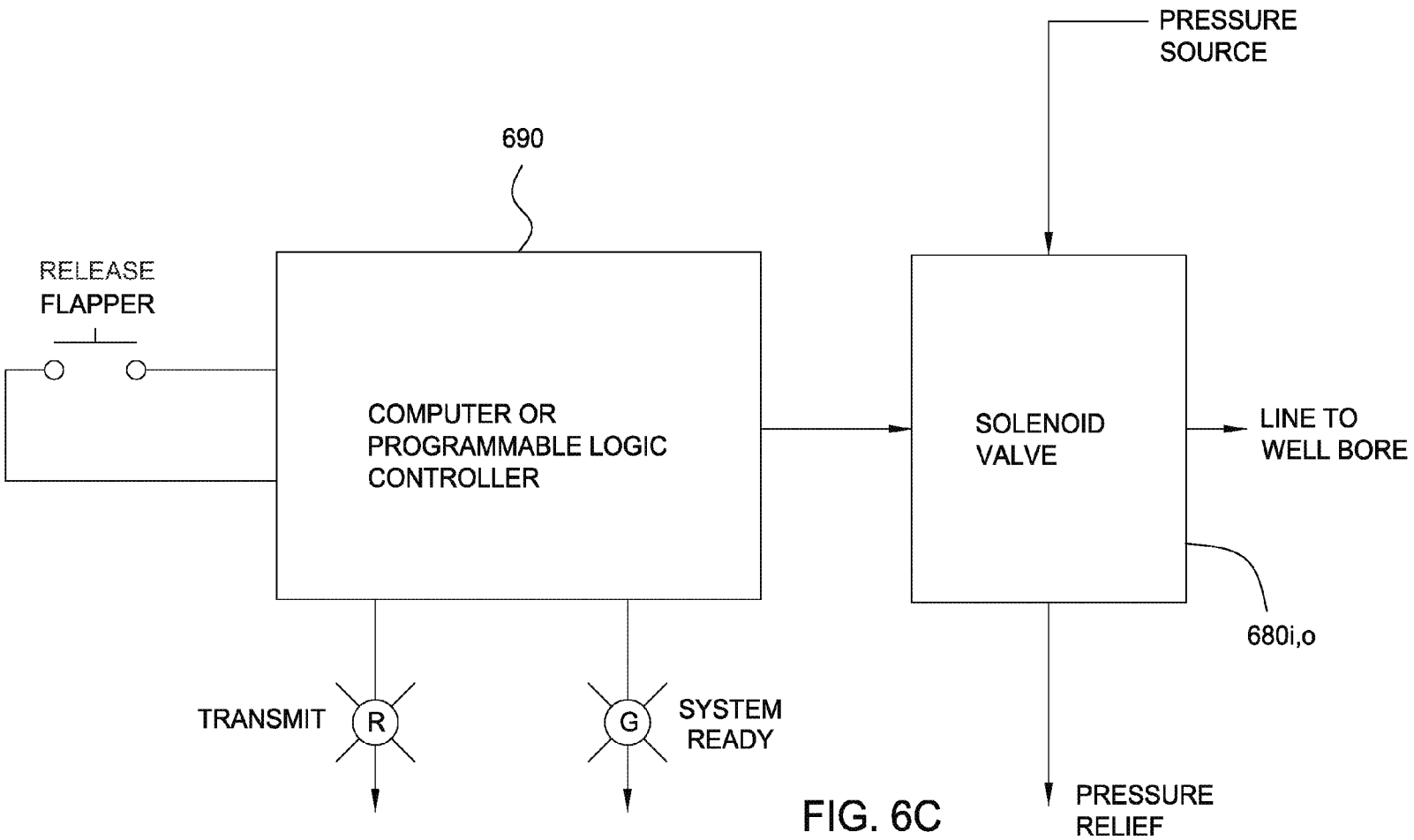
FIG. 6C illustrates the computer/PLC of the surface equipment.

FIG. 6C illustrates the computer/PLC 690. The computer/PLC may be disposed in an operator interface (not shown), such as a console. The interface may include indicator lights R, G to provide visual feedback to the operator. A first light, such as a green light G, may indicate that the computer/PLC is ready to transmit the instruction signal. The console may further include a pushbutton operable to signal the computer to begin transmission of the instruction signal. A second light, such as a red light R, may indicate that the computer is transmitting the instruction signal. The computer/PLC 690 may be in electrical communication with solenoids of the valves 680*i,o*.

Alternatively, instead of mud pulse, the electronics package 650 may include an electromagnetic (EM) receiver or transceiver (not shown) or any other wireless telemetry system. An EM telemetry system is discussed in U.S. Pat. No. 6,736,210, which is hereby incorporated by reference in its entirety.

Figure 7:
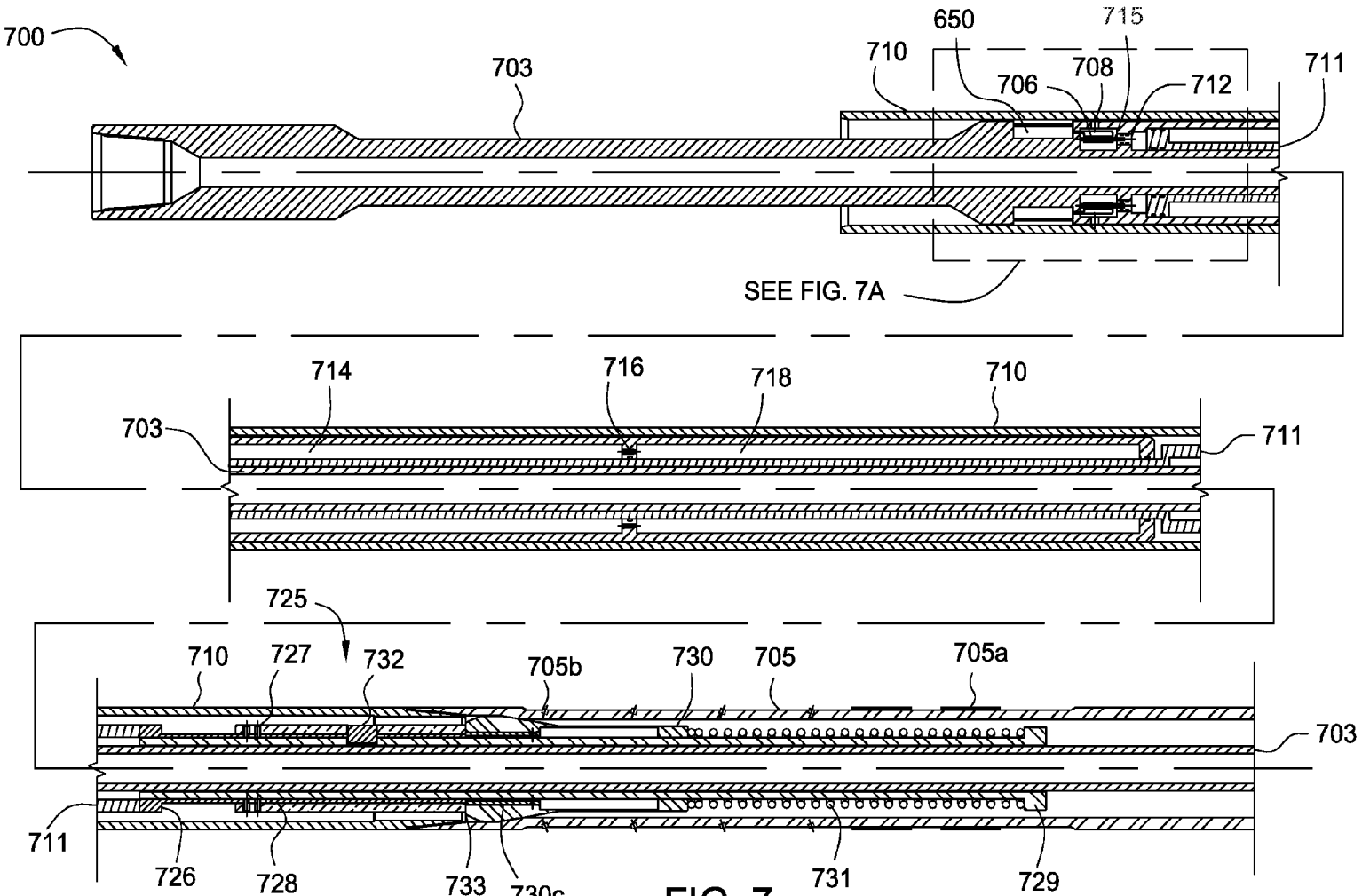
FIG. 7 is a cross-section of a portion of a setting tool and a liner assembly, according to another embodiment of the present invention.

FIG. 7 is a cross-section of a portion of a setting tool 700 and a liner assembly, according to another embodiment of the present invention. The remaining portion of the setting tool 700 and liner assembly may be similar to the setting tool 1 and liner assembly 100 except that the PBR 710 may be moved to between the expandable liner hanger and the run-in string and the isolation valve 200 may be omitted.

The setting tool 700 may include a mandrel 703, a piston 711, a damping chamber 714, a choke 716, an atmospheric chamber 718, a piston actuator, and an expander assembly 725. The mandrel 703 may be a tubular member including a threaded coupling for connecting to the run-in string 685 and a longitudinal bore therethrough. Although shown as one piece, the mandrel 703 may include a plurality of pieces connected by threaded connections and seals to facilitate manufacture and assembly thereof. The piston 711 may be a tubular member having a longitudinal bore therethrough. Although shown as one piece, the piston 711 may include a plurality of pieces connected by threaded connections to facilitate manufacture and assembly thereof. The piston 711 may be disposed between inner and outer walls of the mandrel 703. The piston 711 may include a head formed at a top thereof. One or more seals, such as O-rings, may be disposed between an inner surface of the head and the inner wall and between an outer surface of the head and the outer wall.

The chambers 714, 718 may be formed between the piston 711 and the outer wall of the mandrel 703. The mandrel may include a partition dividing the chambers 714, 718. A seal, such as an O-ring may be disposed between the piston 711 and the partition. One or more chokes 716 may be disposed in the partition. The chokes 716 may provide limited fluid communication between the chambers 714, 718, thereby damping longitudinal movement of the piston. The chambers 714, 718 may be sealed at the surface under atmospheric pressure. The damping chamber 714 may be filled with a hydraulic fluid, such as oil. The atmospheric chamber 718 may be filled with a gas, such as air.

The expander assembly 725 may include an actuator 726, one or more frangible members, such as shear screws 727, a pusher 728, a mandrel 729, a collet 730, a biasing member, such as a spring 731, one or more retainers 732, and a spacer 733. The expander mandrel 729 may be tubular and disposed along an outer surface of the setting mandrel 703 so that the expander mandrel is longitudinally movable relative to the setting mandrel 703. The expander mandrel may include a shoulder formed at a bottom thereof. The collet 730 may be disposed along an outer surface of the expander mandrel and include a base ring formed at a bottom thereof.

The spring may be disposed between the base ring and the expander mandrel shoulder, thereby biasing the collet 730 longitudinally away from the expander mandrel shoulder. The collet 730 may include a plurality of radially split cones 730*c* each extending longitudinally from the base ring. The cones 730*c* may be radially split so that the cones may be radially movable between an expanded position (shown) and a retracted position. An inner surface of the cones 730*c* may be held in the expanded position by abutment with the spacer 733. An outer surface of the cones may abut the liner hanger 705. A top of the cones 730*c* may abut a bottom of the pusher 728. The spacer 733 may be longitudinally coupled to the actuator 726 by one or more fasteners, such as screws. The pusher 728 may be longitudinally coupled to the actuator 726 by the shear screws 727.

The actuator 726 may be tubular and have a head formed at a top thereof. The actuator may further have one or more windows formed through a wall thereof. One of the retainers 732 may be disposed through each window. Each retainer may be received by a groove formed in an outer surface of the expander mandrel and fastened to the expander mandrel. Each retainer may also be disposed through a respective opening formed through a wall of the pusher. The retainers may be blocks and longitudinally couple the pusher to the mandrel. The windows may be sized to allow relative longitudinal movement of the actuator relative to the blocks should the shear screws fail. The collet 730 may have a recessed inner surface formed between the base ring and the cones 730*c* for receiving a lower portion of the actuator and the spacer 733 should the shear screws fail. The bottom shoulder of the piston may also include a recessed inner surface for receiving an upper portion of the expander mandrel should the shear screws fail. The actuator head may abut the bottom shoulder of the piston 711.

In operation, longitudinal movement of the piston 711 may push the expander assembly 725 downward along the hanger 705, thereby expanding the hanger into engagement with the previously set liner/casing. If the annulus between the hanger 705 and the liner/casing is sufficient, the hanger 705 may expand as forced by the expanded cones 730*c*. However, if the annulus is insufficient, the reaction force may increase to fracture the shear screws 727. As shown in FIG. 7B, the actuator 726 and the spacer 733 may then be free to move longitudinally relative to the rest of the expander assembly, thereby moving the spacer 733 from the inner surface of the cones and replacing the spacer 733 with the outer surface of the actuator 726 which may have a reduced outer diameter. The reduced outer diameter may allow the cones to move radially inward to the retracted position. Movement of the actuator 726 may continue until a lower surface of the actuator head abuts a top of the pusher 728, thereby resuming movement of the expander assembly 725 downward through the hanger 705. The reduced outer diameter of the cones 730*c* may reduce the expanded outer diameter of the hanger 705 which may suitable for the smaller annulus.

Figure 7A:
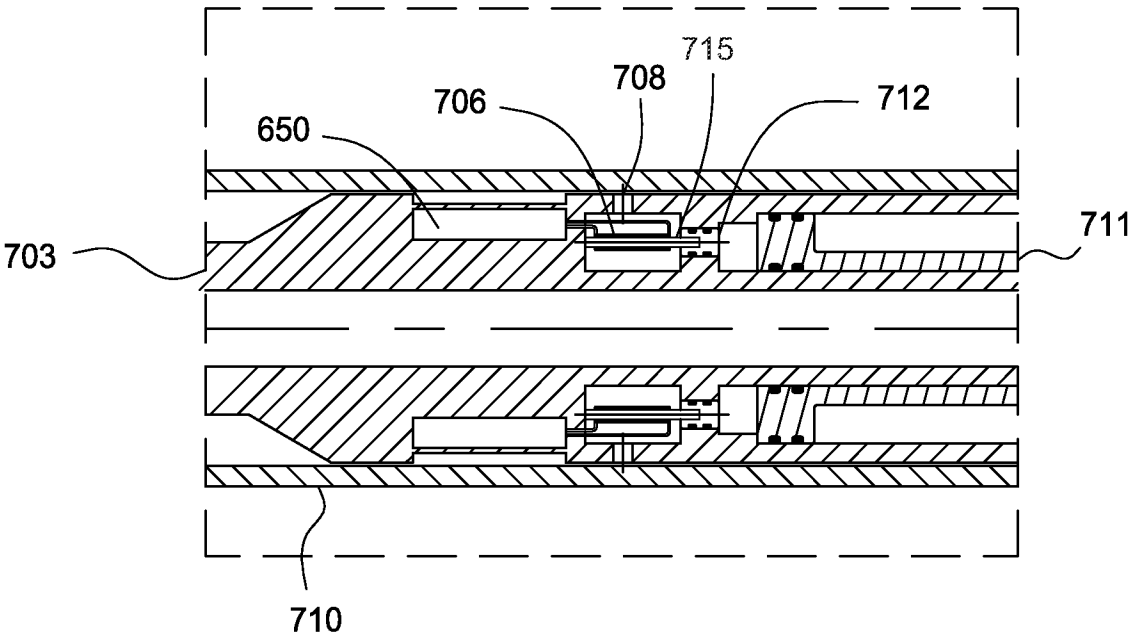
FIG. 7A is an enlarged view of a piston actuator of the setting tool.
Figure 7B:
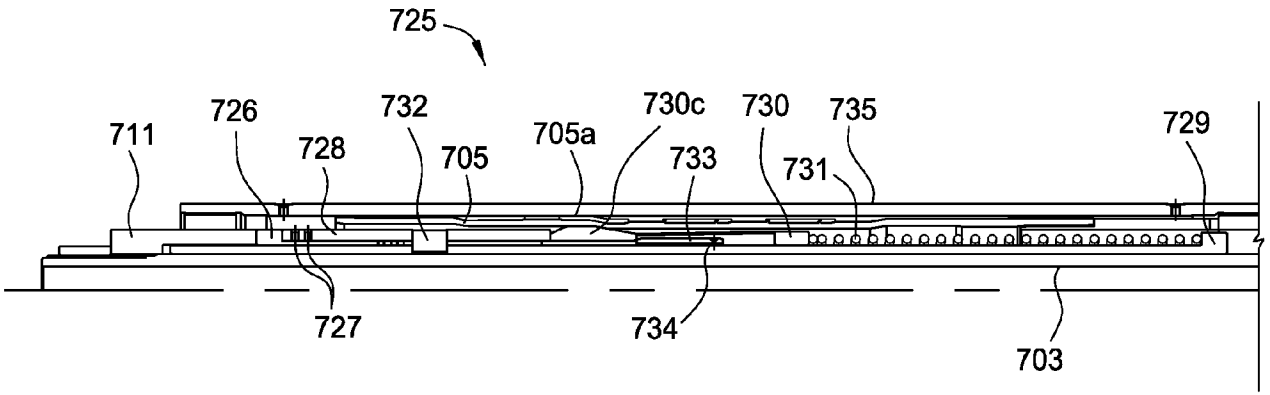
FIGS. 7B and 7C illustrate an expander assembly of the setting tool according to an embodiment of the invention.
Figure 7C:
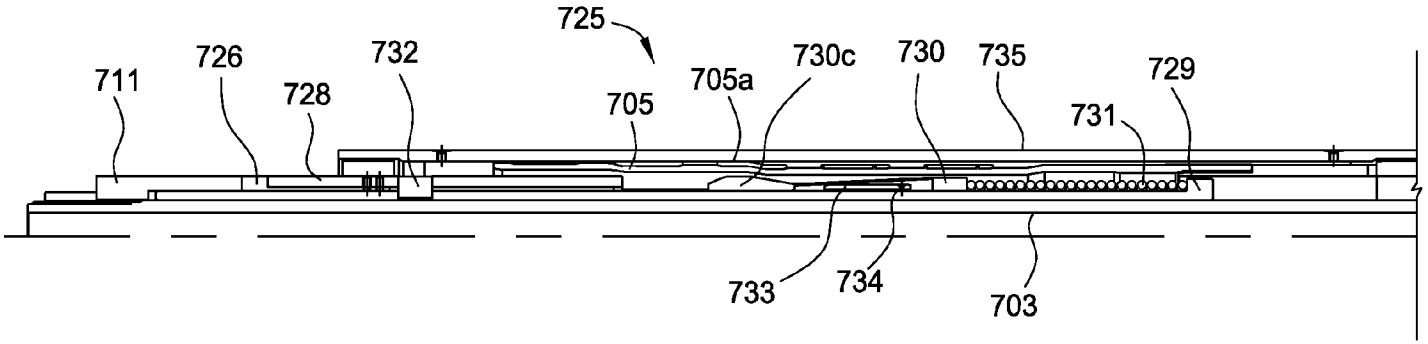

As illustrated in FIG. 7C, after expansion of the liner hanger 705 into engagement with an existing casing 735 or at some other point during operation of the setting tool 700, when the expander assembly 725 is removed from the liner assembly the cones 730*c* are operable to collapse into an even further reduced outer diameter configuration. The spacer 733 may be releasably coupled to the actuator 726 by one or more frangible members, such as shear screws 734. The cones 730*c*, which are seated on the outer surface of the actuator 726, may be forced against the end of the spacer 733 to shear the shear screws 734 and allow the cones 730*c* to move relative to the actuator 726. The cones 730*c* may then be moved off of the actuator 726 outer surface until the cones 730 and the spacer 733 are seated on the outer surface of the mandrel 729, thereby further reducing the outer diameter of the cones 730*c*. In one embodiment, during retrieval of the expansion assembly 725, a restriction, such as an inner diameter shoulder of a component of the liner assembly or a narrowed inner diameter portion of the existing casing 735 may engage the cones 730*c* and obstruct passage therethrough. An upward or pull force applied to the run-in string and/or the mandrel 703 may cause a reaction force to be applied to the cones 730*c* against the restriction. The reaction force may be transferred through the cones 730*c* and applied to the spacer 733 until the shear screws 734 release engagement with the actuator 726. The reaction force may then move the cones 730*c* and the spacer 733 relative to the actuator 726 onto the outer surface of the mandrel 729, thereby reducing the outer diameter of the cones 730*c* and allowing the expander assembly 725 to be moved past the restriction.

FIG. 7A is an enlarged view of the piston actuator. The piston actuator may include the electronics package 650, one or more heating coils 706, one or more ports 708, one or more retainers, such as fusible rods 715, and a plug 712. The ports may provide fluid communication between the wellbore and a first chamber formed in the mandrel 703. The plug may be disposed in a passage between the first chamber and a second chamber in communication with a top of the piston head. The second chamber may be sealed at the surface under atmospheric pressure and be filled with a gas, such as air. One or more seals, such as O-rings, may be disposed between each plug and the passage. Each plug may be longitudinally restrained in the passage by a respective rod.

In operation, when the electronics package detects an instruction signal from the surface, the microprocessor may supply electricity to the heating coil, thereby heating the rod. The increased temperature of the rod may weaken the rod until hydrostatic pressure exerted on a top of the plug fractures the rod, thereby freeing the plug. The plug may be pushed into the second chamber by wellbore fluid, thereby opening the passage. Wellbore fluid may enter the second chamber through the open passage and exert hydrostatic pressure on the top of the piston head, thereby longitudinally moving the piston downward toward the expander assembly. The piston head may push the oil through the choke 716 and into the atmospheric chamber 718, thereby controlling a rate of movement of the piston. As discussed above, movement of the piston may operate the expander assembly 725, thereby setting the hanger 705. Cementing may occur as discussed above in relation to FIGS. 3A-3D.

Since the mud pulse signal can be varied, several difference devices can be operated down hole each with a unique signal, e.g. a surge reduction valve (see U.S. Pat. No. 6,834,726, which is hereby incorporated by reference in its entirety) that allows for faster run in of the liner before cementing can be closed prior to cementing; setting the liner hanger with a vacuum operated jack system—note several vacuum chambers can be operated in series if the hydrostatic pressure is too low for a single vacuum chamber jack to set the liner hanger; releasing the running tool from the liner hanger after the liner hanger is set; etc.

Figure 8A:
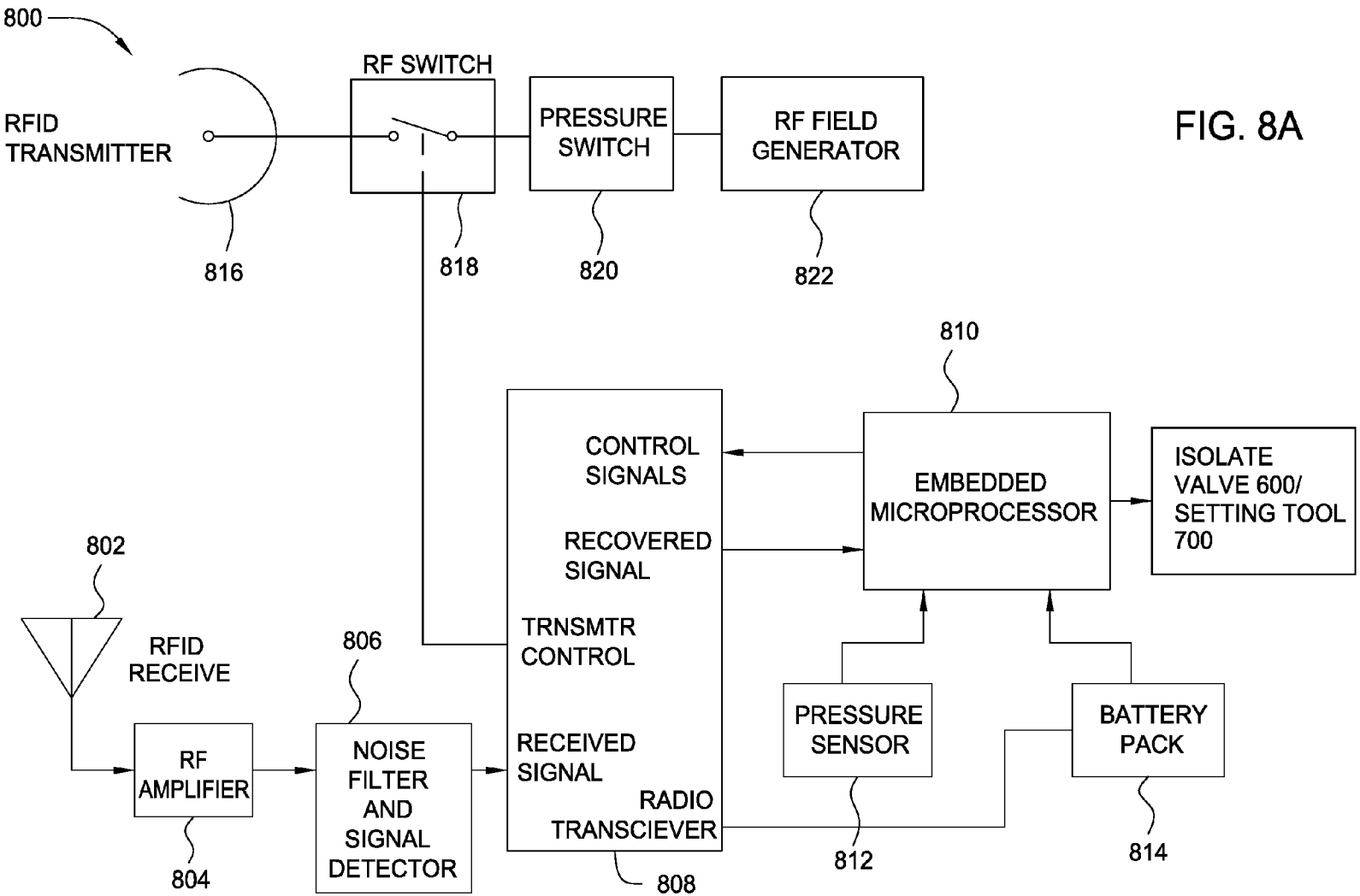
FIG. 8A illustrates a radio-frequency identification (RFID) electronics package, according to another embodiment of the present invention.
Figure 8C:
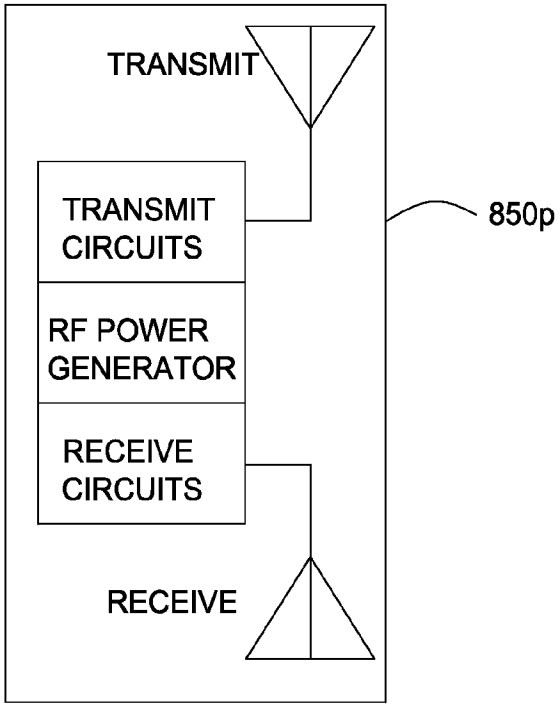
FIG. 8C illustrates a passive RFID tag.
Figure 8B:
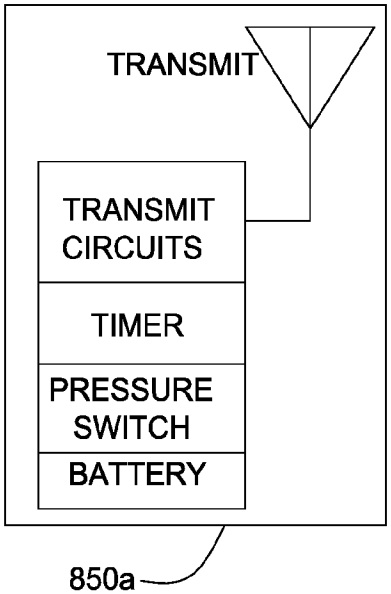
FIG. 8B illustrates an active RFID tag.

FIG. 8A illustrates a radio-frequency identification (RFID) electronics package 800, according to another embodiment of the present invention. FIG. 8B illustrates an active RFID tag 850*a*. FIG. 8C illustrates a passive RFID tag 850*p*. The RFID electronics package 800 may be used instead of the electronics package 650 in the isolation valve 600 and/or the electronics package 750 in the setting tool 700. The electronics package 800 may communicate with a passive RFID tag 850*p* or an active RFID tag 850*a*. Either of the RFID tags 850*a,p* may be embedded in the top plug 320 so that the electronics package 800 may detect passage of the top plug 320 thereby. Alternatively, either of the RFID tags may be embedded in a ball, plug, bar or some other device used to initiate the release of a downhole valve.

The RFID electronics package 800 may include a receiver 802, an amplifier 804, a filter and detector 806, a transceiver 808, a microprocessor 810, a pressure sensor 812, battery pack 814, a transmitter 816, an RF switch 818, a pressure switch 820, and an RF field generator 822. If the active RFID tag 850*a* is used, the components 816-822 may be omitted.

If a passive tag 850*p* is used, once the isolation valve 600 or setting tool 700 is deployed to a sufficient depth in the wellbore, the pressure switch 820 may close. The pressure switch may remain open at the surface to prevent the electronics package 800 from becoming an ignition source. The microprocessor may also detect deployment in the wellbore using pressure sensor 812. The microprocessor 810 may delay activation of the transmitter for a predetermined period of time to conserve the battery pack 814. The microprocessor may then begin transmitting a signal and listening for a response. Once the top plug is pumped into proximity of the transmitter 816, the passive tag 850*p* may receive the signal, convert the signal to electricity, and transmit a response signal. The electronics package 800 may receive the response signal, amplify, filter, demodulate, and analyze the signal. If the signal matches a predetermined instruction signal, then the microprocessor 810 may monitor pressure for a predetermined threshold indicative that the top plug 320 has seated against the wiper and/or wait a predetermined period for the top plug to seat. Once the predetermined threshold is detected and/or the time period has passed, the microprocessor may close the isolation valve or operate the setting tool.

If the active tag 850*a* is used, then the tag 850*a* may include its own battery, pressure switch, and timer so that the tag 850*a* may perform the function of the components 816-822.

Since the tags send out unique signals, multiple receivers may be used. For example one receiver may be used to close a surge reduction valve; another receiver may start a sequence leading to the operation of the setting tool 700 to set the liner hanger and release the running tool.

Figures 9A, 9B, 9C, 9D, 9E, 9F:
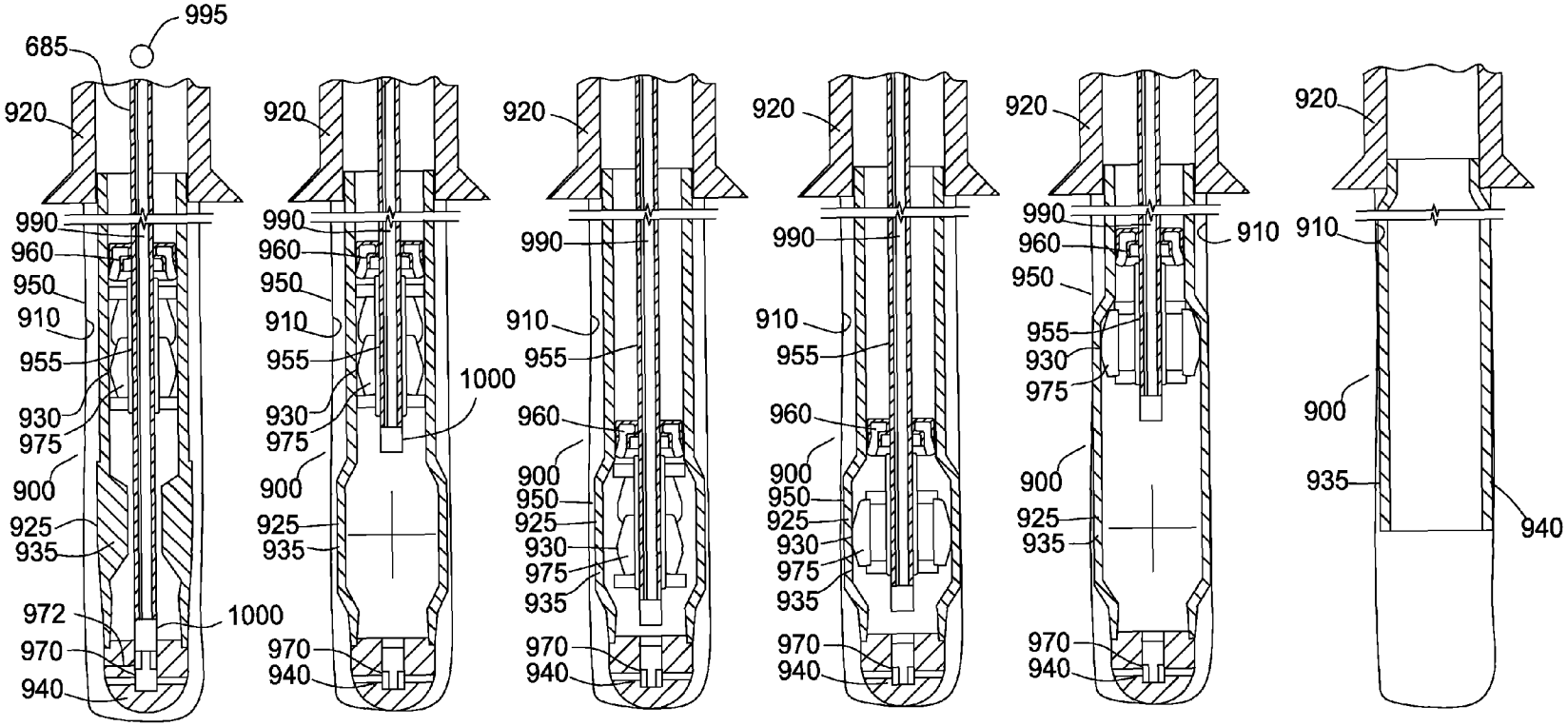
FIG. 9A is a sectional view of an expandable liner system disposed in a wellbore proximate a lower end of a string of casing, according to another embodiment of the present invention.
FIG. 9B is a sectional view illustrating the reforming or unfolding of a corrugated liner to form a launcher of the expandable liner system.
FIG. 9C is a sectional view of the expansion system after positioning a two-position expander in the launcher.
FIG. 9D is a sectional view of the expandable liner system illustrating the expansion of the corrugated liner section.
FIG. 9E is a sectional view of the expandable liner system illustrating the expansion of the upper liner section.
FIG. 9F is a sectional view of the completed wellbore.

FIG. 9A is a sectional view of an expandable liner system 900 disposed in a wellbore 910 proximate a lower end of a string of casing 920, according to another embodiment of the present invention. The system 900 may include a liner assembly 925 and an expander assembly 950. The expandable liner system 900 may be run-into the wellbore 910 using the run-in string 685. The wellbore section below the casing 920 may be drilled without an underreamer. The liner assembly 925 may be set in the casing 920 by positioning an upper portion of the liner assembly 925 in an overlapping relationship with a lower portion of the casing 920. Thereafter, the expansion assembly 950 may be employed to expand the liner assembly 925 into engagement with the casing 920 and the surrounding wellbore 910.

The liner assembly 925 may include a tubular section 930 at an upper end thereof and a shaped or a corrugated liner section 935 disposed at the lower end thereof. It must be noted that the shape or corrugation of the liner section 935 is optional such that the liner section 935 is substantially cylindrical. Alternatively, the corrugated liner section 935 may be located at any position along the liner assembly 925. A cross section of a suitable corrugated liner section may be found at FIG. 2G of U.S. Pat. No. 7,121,351, which is herein incorporated by reference in its entirety. The corrugated liner section 935 and the substantially cylindrical liner section 930 may be connected by a threaded connection or may be one continuous tubular body. The corrugated liner section 935 may be fabricated from a drillable material, such as aluminum or a pliable composite. The corrugated liner section 935 may have a folded wall having an initial inner diameter which may be reformed to define a larger second folded inner diameter and subsequently may be expanded to an even larger unfolded diameter. The corrugated liner section 935 may be folded or deformed prior to insertion into the wellbore 910, to a non-tubular-shape, such as a hypocycloid, so that grooves are formed along the length of the corrugated liner section 935. The grooves may be symmetric or asymmetric.

The liner assembly 925 may further include a shoe 940 at the lower end thereof. The shoe 940 may be longitudinally coupled to the corrugated portion, such as by a threaded connection. The shoe 940 may be a tapered or bullet-shaped and may guide the liner assembly 925 toward the center of the wellbore 910. The shoe 940 may minimize problems associated with hitting rock ledges or washouts in the wellbore 910 as the liner assembly 925 is lowered into the wellbore. An outer portion of the shoe 940 may be made from steel. An inner portion of the shoe 940 may be made of a drillable material, such as cement, aluminum or thermoplastic, so that the inner portion may be drilled through if the wellbore is to be further drilled. A bore may be partially formed longitudinally through the shoe 940 and in fluid communication with one or more ports radially formed through the shoe. A sleeve 970 may be disposed in the bore and longitudinally movable between an open position exposing the ports and a closed position covering the ports, thereby fluidly isolating the ports from the bore. The sleeve 970 may be restrained in the open position by one or more frangible members 972, such as shear screws.

Alternatively, the sleeve may have one or more ports formed radially therethrough and aligned with the shoe ports in the open position. The sleeve may be restrained in the open position by the threaded coupling between the valve 1000 and the shoe 940 and biased toward the closed position by a spring. Unthreading of the valve 1000 from the shoe 940 may release the sleeve, thereby allowing the spring to move the sleeve so that a solid portion of the sleeve covers the ports, thereby fluidly isolating the ports from the bore.

The expander assembly 950 may be disposed in the liner assembly 925. The expander assembly 950 may include a tubular mandrel 955. An upper end of the mandrel 955 may be connected to the work string 685 by a threaded connection and a lower end of the mandrel 955 may be releasably connected to the shoe 940, such as by a threaded connection. The mandrel 955 may have a bore 990 formed therethrough in fluid communication with the surface of the wellbore 910 via a bore of the run-in string 685. The mandrel 955 may support the liner assembly 925 during run-in.

The expander assembly 950 may further include a seal 960 longitudinally coupled to the mandrel 955 and engaged with an inner surface of the tubular portion 930. The seal 960 may be fabricated from a pliable material, such as an elastomer. The seal 960 may act as a piston to move the expansion assembly 950 through the tubular section 930 upon introduction of fluid pressure below the seal 960. Additionally or alternatively, tension from the run-in string may 685 be used to move the expansion assembly 950 through the tubular section 930.

The expander assembly 950 may further include a two-position expander 975. Detailed views of a suitable two-position expander may be found at FIGS. 3A and 3B of U.S. Pat. No. 7,121,351. The two-position expander may include a first assembly and a second assembly. The first assembly may include a first end plate and a plurality of first cone segments and the second assembly may include a second end plate and a plurality of second cone segments. Each end plate may be substantially round and have a plurality of T-shaped grooves formed therein. Each groove may match a T-shaped profile formed at an end of each cone segment.

An outer surface of each cone segment may include a first taper and an adjacent second taper. The first taper may have a gradual slope to form the leading shaped profile of the two-position expander 975. The second taper may have a relatively steep slope to form the trailing profile of the two-position expander 975. The inner surface of each cone segment may have a substantially semi-circular shape to allow the cone segments to slide along an outer surface of the mandrel 955. A track portion may be formed on each first cone segment. The track portion may be used with a mating track portion formed on each second cone segment to align and interconnect the cone segments. The track portions may be a tongue and groove arrangement.

The first assembly and the second assembly may be urged longitudinally toward each other along the mandrel. As the first assembly and the second assembly approach each other, the first and second cone segments may be urged radially outward. As the first and second segments travel longitudinally along respective track portions, a front end of each second cone segment wedges the first cone segments apart, thereby causing the first shaped profiles to travel radially outward along the first shaped grooves of the first end plate. Simultaneously, a front end of each first cone segment wedges the second cone segments apart, thereby causing the second shaped profiles to travel radially outward along the second shaped grooves of the second end plate. The radial and longitudinal movement of the cone segments continues until each front end contacts a stop surface on each end plate, respectively. In this manner, the two-position expander 975 is moved from a retracted position having a first diameter to an expanded position having a second diameter that is larger than the first diameter.

Figure 10:
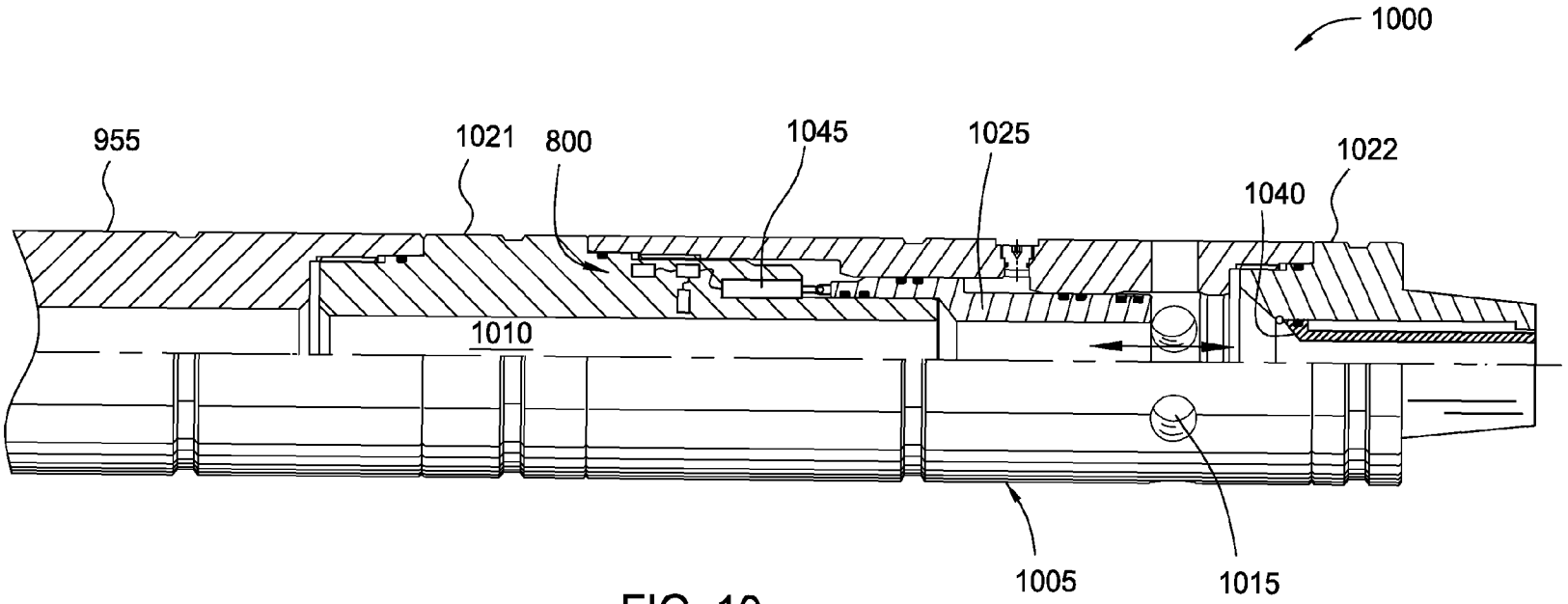
FIG. 10 is a cross section of a valve of the expandable liner system.

FIG. 10 is a cross section of an electric valve 1000. The expander assembly may further include the valve 1000. The valve 1000 may include a body 1005 having a bore 1010 therethrough. The body 1005 may include an upper sub 1021, a lower sub 1022, and a sliding sleeve 1025 disposed therebetween. The upper and lower subs 1021, 1022 may include threaded couplings for connection to the mandrel 955 and shoe 940, respectively. A series of ports 1015 may be formed through a wall of the body 1005 for fluid communication between the interior and the exterior of the valve 1000. One or more seals 1030 may be provided to prevent leakage between the sleeve 1025 and the subs 1021, 1022. The sliding sleeve 1025 may be longitudinally movable relative to the body 1005 for selectively opening and closing the ports 1015.

The valve 1000 may further include an actuator 1045 for moving the sliding sleeve 1025. The actuator 1045 may be a linear actuator. The valve may further include the RFID electronics package 800 for operating the actuator in response to instruction from a ball 995 having one of the RFID tags 850*p,a* embedded therein. Alternatively, the electronics package 650 may be used instead. The sub 1022 may include a ball seat 1040 disposed therein and longitudinally movable relative thereto for receiving the RFID ball 995, thereby closing the bore 1010 and longitudinally moving a longitudinal end of the ball seat 1040 into engagement with the sleeve 970.

The expandable liner system 900 may be lowered into the wellbore 910 while receiving displaced wellbore fluid through the shoe 940. Alternatively or additionally, fluid may be circulated to remove debris from the wellbore. After the system 900 is positioned within the wellbore 910, the RFID ball 995 may be pumped from the surface through the run-in string 685 and the bores 990, 1005 to the seat 1040. Once the ball 995 has seated, fluid pressure may increase and cause the seat 1040 to push the sleeve 970, thereby fracturing the shear screws 972 and closing the shoe ports.

The RFID ball 995 may include instructions for the electronics package 850 to open the ports 1015 after a predetermined time sufficient to sufficient for the sleeve 970 to close the shoe ports and/or after detecting a pressure sufficient to close the sleeve 970.

FIG. 9B is a sectional view illustrating the reforming or unfolding of the corrugated liner 935 to form a launcher. The launcher may be formed to house the unactuated two-position-expander 975 prior to expanding the liner assembly 925 into contact with the wellbore 910. The mandrel 955 may be released from the shoe 940, such as by rotation of the mandrel from the surface. Fluid may then be pumped from the surface through the bore 990 and into the liner assembly 925 via the open ports 1015. As fluid pressure increases in the liner assembly 925, the corrugated liner section 935 may start to reform or unfold from the folded diameter to the larger folded diameter due to the fluid pressure. In this manner, the launcher is formed in the liner assembly 925.

FIG. 9C is a sectional view of the expansion system 900 after positioning the two-position expander 975 in the launcher. After the launcher is formed, the fluid pressure below the seal 960 may be released by allowing fluid to exit through the tubular member 955. The expander 975 may then be lowered into the launcher. The electronics package 850 may close the ports 1015 after a predetermined time sufficient to sufficient for the launcher to be formed and pressure to be relieved and/or after detecting the pressure sequence for forming the launcher and relieving pressure from the liner assembly.

FIG. 9D is a sectional view of the expandable liner system 900 illustrating the expansion of the corrugated liner section 935. Once the ports 1015 have been closed, pressure in the bore 990 may be increased to activate a hydraulic actuator (not shown). The hydraulic actuator may move the expander 975 from the retracted position to the expanded position. The hydraulic actuator may be similar to any of the hydraulic actuators used in any of the isolation valves or setting tools discussed herein.

The electronics package 850 may open the ports 1015 after a predetermined time sufficient for actuation of the expander 975 to the expanded position and/or after detecting pressure sufficient for actuation of the expander 975 to the expanded position.

Once the expander 975 has been moved to the expanded position and the ports 1015 have opened, additional fluid pressure may be introduced through the bore 990 and the ports 1015 and into the liner assembly 925 (below the seal 960) to move the expander assembly 950 relative to the liner assembly 925. The two-position expander 975 may expand the corrugated liner section 935 from the folded diameter to the unfolded diameter. During expansion, the two-position expander 975 may "iron out" the crinkles in the corrugated liner section 935 so that the corrugated liner section 935 is substantially reformed into its initial, substantially tubular shape. Reforming and subsequently expanding allows further overall expansion of the corrugated liner section 935 than would be possible with a tubular shape.

FIG. 9E is a sectional view of the expandable liner system 900 illustrating the expansion of the upper liner section 930. Additional fluid may be introduced through the bore 990 and the ports 1015 and into the liner assembly 925 (below the seal 960) to continue the movement of the expansion assembly 950 relative to the liner assembly 925 until substantially the entire length of liner sections 930, 935 are expanded into contact with the surrounding wellbore 910 and the casing 920.

FIG. 9F is a sectional view of the completed wellbore 910. Once the expander 975 has reached the bottom of the casing and expanded the overlapping liner into engagement with the bottom of the casing, the expander assembly 950 may be removed from the wellbore. A drill string (not shown) having a drill bit disposed on a lower end thereof may be deployed into the wellbore 910 and a lower portion of the liner 935 and the shoe 940 may be drilled through. Drilling of the wellbore 910 may then be continued. Cementing of the expanded liner assembly 935 may not be required. Alternatively, cement may be employed (before unfolding the corrugated portion and expanding the liner) to seal an annulus formed between the liner sections 930,935 and the surrounding wellbore 910.

Figure 11:
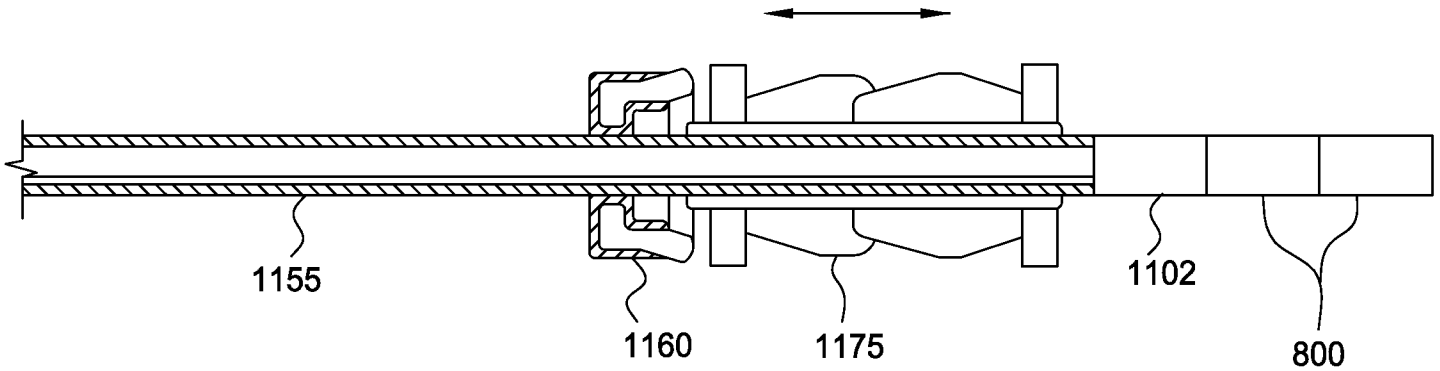
FIG. 11 illustrates an alternative expansion assembly, according to another embodiment of the present invention.

FIG. 11 illustrates an alternative expansion assembly 1150, according to another embodiment of the present invention. Instead of the hydraulic actuator and valve 1000 used in the expansion assembly 950, the expansion assembly may include an electric motor 1102 operated by the RFID electronics package 800. The sleeve 970 may be replaced by a ball seat. The RFID ball 995 may then be pumped to the ball seat in the shoe. The electronics package 800 may then wait for the launcher to be formed and the expander 1175 to be moved into the launcher. The electronics package may then operate the motor 1102. A portion of the expander 1175 may be longitudinally coupled to a gear (not shown), such as a worm gear, rotationally coupled to the motor 1102 such that rotation of the motor may move the portion of the expander longitudinally relative to another portion of the expander, thereby moving the expander between the retracted and expanded positions.

Alternatively, the corrugated portion 935 may be formed into the launcher using a lower cone (not shown) instead of or in addition to fluid pressure. Such an expansion system is illustrated in FIGS. 5A-D of the '351 patent. The alternative expansion system may utilize a hydraulic actuator to drive the lower cone into the corrugate portion 935 similar to FIGS. 9A-9F or the electric motor 1102. Alternatively, the expansion system 550 illustrated in FIGS. 5A-D of the '351 patent may be used instead of the expansion systems 950, 1150 and modified by replacing the hydraulic valve 555 with the electric valve 1000 in order to selectively open and close hydraulic ports 520, 565. A second actuator may be added to the electric valve and the ball seat 1040 may be replaced by the sleeve that closes port 565 in FIGS. 5A-D of the '351 patent. The second actuator may then move the sleeve to close the port. The first actuator 1045 and the ports 1015 may replace the ports 520 of the hydraulic valve 555. The shoe 590 may be modified to include a ball seat for catching the RFID ball 995. The rest of the operation of the modified expansion system may be similar to that of the expansion system 555 discussed and illustrated in the '351 patent.

Figure 12:
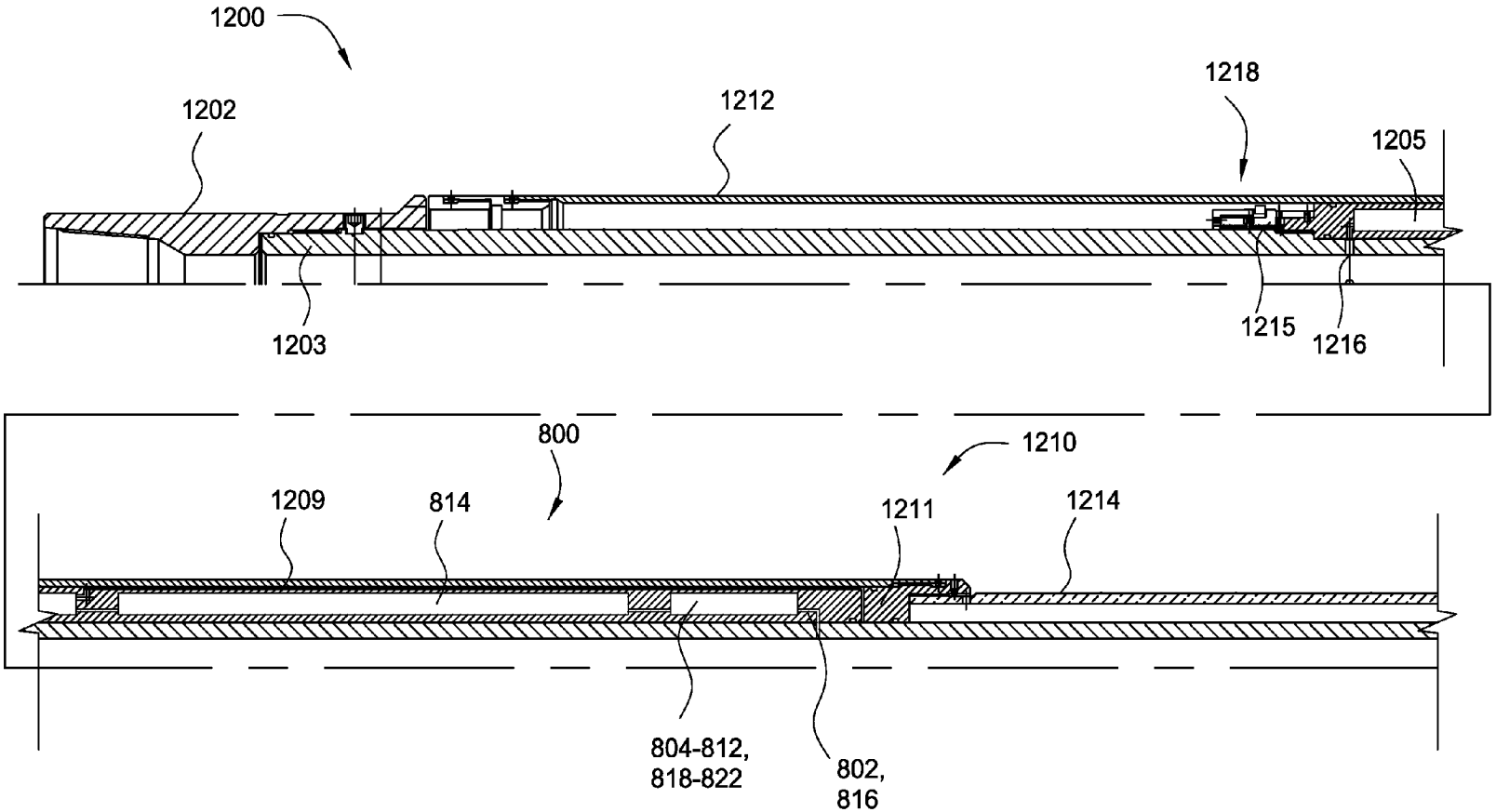
FIG. 12 is a half section of a portion of a setting tool, according to another embodiment of the present invention.

FIG. 12 is a half section of a portion of a setting tool 1200, according to another embodiment of the present invention. The remainder of the setting tool 1200 may be similar to the setting tool 1 or the setting tool 700 except that the isolation valve 200 may be omitted.

The setting tool 1200 may include a connector sub 1202, a mandrel 1203, a piston assembly 1210*a*, a pump 1205, and the electronics package 800. The connector sub 1202 may be a tubular member including a threaded coupling for connecting to the run-in string 685 and a longitudinal bore therethrough. The connector sub 1202 may also include a second threaded coupling engaged with a threaded coupling of the mandrel 1203. One or more fasteners, such as set screws may secure the threaded connection between the connector sub 1202 and the mandrel 1203. The mandrel 1203 may be a tubular member having a longitudinal bore therethrough and may include one or more segments connected by threaded couplings.

The piston assembly 1210 may include piston 1211, sleeves 1212, 1214, housing 1215, inlets 1216, flow path 1209, and ratchet assembly 1218. The piston 1211 may be an annular member. An inner surface of the piston 1211 may engage an outer surface of the mandrel 1203 and may include a recess having a seal, such as an o-ring disposed therein. The inlet 1216 may be formed radially through a wall of the mandrel 1203 and provide fluid communication between a bore of the mandrel 1203 and an inlet of the pump 1205. The sleeves 1212, 1214 may be longitudinally coupled to the piston 1211 by threaded connections. A seal, such as an o-ring, may be disposed between the piston 1211 and the sleeves 1212. Each of the sleeves 1212, 1214 may be a tubular member having a longitudinal bore formed therethrough and may be disposed around the mandrel 1203, thereby forming an annulus therebetween. The housing 1215 may be a tubular member, disposed around the mandrel 1203, and longitudinally coupled thereto by a threaded connection. The housing 1215 may also be disposed about a shoulder formed in or disposed on an outer surface of the mandrel 1203. Seals, such as o-rings, may be disposed between the housing 1215 and the mandrel 1203 and between the housing 1215 and the sleeve 1212.

An end of the sleeve 1212 may be exposed to an exterior of the setting tool 1200. The end of the sleeve 1212 may further include a profile formed therein or fastened thereto by a threaded connection. The profile may mate with a corresponding profile formed on an outer surface of the ratchet assembly 1218, thereby longitudinally coupling the ratchet 1218 and the sleeve 1212 when the piston 1211 is actuated. The sleeve profile may engage the ratchet profile by compressing a spring, such as a c-ring. The c-ring may then expand to lock in a groove of the sleeve profile. Teeth formed on inner and outer surfaces of a lock ring of the ratchet assembly 1218 respectively engage corresponding teeth formed on an outer surface of the mandrel 1203 and an inner surface of a ring housing, thereby longitudinally locking the sleeve 1212 and thus the expander assembly 25 once the sleeve 1212 engages the ratchet assembly 1218.

The pump 1205 and the electronics package may be disposed in the housing 1215. The housing 1215 may include an inlet providing fluid communication between an inlet of the pump and the mandrel inlet. The housing may include an outlet providing fluid communication between an outlet of the pump and the flow path 1209. The flow path 1209 may be formed between a recessed outer surface of the housing 1215 and an inner surface of the sleeve 1212. The flow path 1209 may provide fluid communication between an outlet of the pump 1205 and a top of the piston 1211.

In operation, one of the RFID tags 850*a,p* may be embedded in the top plug 320. When the top plug passes the electronics package 800, the microprocessor may receive an instruction signal from the tag 850*a,p*. The microprocessor 810 may then wait a predetermined period of time and/or detect a pressure indicative of seating of the top plug against the float collar/shoe. The microprocessor may then supply electricity from the battery pack 814 to an electric motor of the pump 1205. The pump may intake the displacement fluid from the mandrel bore via inlet 1216, pressurize the displacement fluid, and discharge the pressurized displacement fluid into the flow path 1209, thereby longitudinally moving the piston 1211 and setting the hanger 105.

Additionally, the microprocessor 810 may detect setting of the hanger 105, such as by including a switch (not shown) in the ratchet assembly that is closed when the sleeve 1212 engages the ratchet assembly or a flow meter or stroke counter in the pump 1205. Once the microprocessor 810 detects setting of the hanger 105, the microprocessor may cease the electricity supply to the pump 1205 and then intermittently supply and cease electricity to the pump 1205, thereby creating pressure pulses that may be detected at the surface. Alternatively, the microprocessor may intermittently supply and cease reversed polarity electricity to the pump, thereby reversing flow through the pump.

If the latch 50 does not release upon application of pressure in the mandrel bore, then a ball may be dropped through the run-in string and the mandrel bore to the ball seat, thereby isolating the liner from the mandrel bore. Pressure may then be further increased to release the latch.

Alternatively, the latch 50 may include an actuator, such as any of the actuators discussed above for the isolation valves, setting tools, or expanders, and the electronics package 650. The microprocessor 660 may detect the pressure pulses and operate the actuator, thereby releasing the latch 50 and allowing the setting tool 1200 to be removed from the wellbore. Instead of the electronics package 650, the latch actuator may be in electrical communication with the microprocessor 850 via a wire (not shown) extending through a wall of the mandrel 1203.

FIGS. 13A-D illustrate a cross-section of an isolation valve 1300, according to one embodiment of the invention. The isolation valve 1300 may be used instead of the isolation valve 200 described above. The isolation valve 1300 may include an upper adapter 1305, a lower adapter 1395, one or more couplers 1335, one or more housings 1310, 1340, 1360, one or more seals, such as o-rings 1301, 1302, 1303, 1306, 1307, 1308, 1309, 1311, 1312, 1313, 1314, an upper piston member 1345, a lower piston member 1347, one or more sleeves 1315, one or more pins 1317, 1319, an upper retaining member 1320, a lower retaining member 1325, an upper seat 1321, a lower seat 1327, one or more valve members, such as a ball 1330, and one or more biasing members, such as a spring 1350, and one or more lug rings 1365.

Figures 1, 2, 13A, 13B:
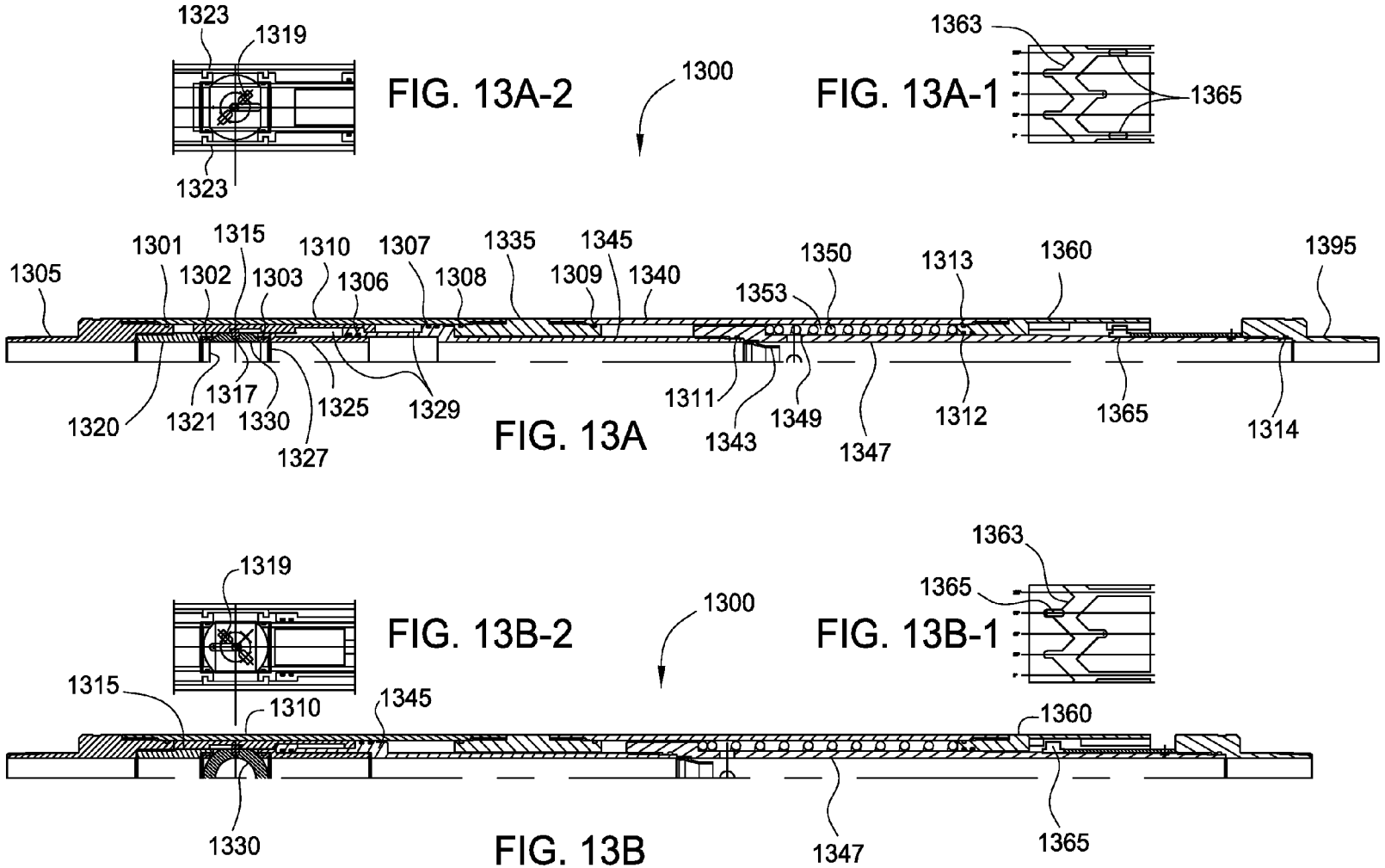

FIG. 13A illustrates an open position of the isolation valve 1300. The upper and lower adapters 1305, 1395 may include cylindrical members having flow bores therethrough to provide fluid communication to the isolation valve 1300. In one embodiment, the upper and lower adapters 1305, 1395 include threaded ends configured to couple the isolation valve 1300 to the setting tool 1 and the wiper assembly 150, respectively, as described above. In one embodiment, the isolation valve 1300 may be located in the setting tool 1 below the seal assembly 75. The housing 1310 is coupled to the exterior surface of the upper adapter 1305 and the upper retaining member 1320 is coupled to the interior surface of the upper adapter 1305, such that the sleeves 1315 are movably disposed between the housing 1310 and the upper retaining member 1320. The sleeves 1315 may include cylindrically shaped bodies that are spaced apart and/or include grooves on their outer surfaces to provide fluid passages between the sleeves 1315 and the housing 1310 for fluid communication with one or more chambers 1329 disposed above the upper piston member 1345. The upper and lower retaining members 1320, 1325 are configured to retain the ball 1330 within the housing 1310, as well as retain the upper and lower seats 1321, 1327 into a sealed engagement with the outer surface of the ball 1330, using one or more retainers 1323 (shown in FIG. 13A-2). The ball 1330 includes a spherical shape having a cylindrical bore disposed therethrough. The one or more pins 1317 may be connected to the ball 1330 and may extend into a slot in the sleeve 1315. The one or more pins 1319 may be connected to the sleeve 1315 and may extend into an opening in the ball 1330 (shown in FIG. 13B-2). The sleeve 1315, ball 1330, and one or more pins 1317, 1319 are configured to provide rotational movement of the ball 1330 upon relative axial movement of the sleeve 1315, thereby opening and closing fluid communication through the bore of the isolation valve 1300. As the sleeve 1315 moves relative to the ball 1330, the pin 1319 moves the ball 1330 and uses the pin 1317 located in the slot of the sleeve 1315 as a pivot point to rotate the ball 1330. The bore of the ball 1330 is rotated into and out of alignment with the bore of the isolation valve 1300 to open and close fluid communication therethrough.

The lower end of the sleeve 1315 is coupled to the upper end of the upper piston member 1345 to allow limited relative movement therebetween and further permit the piston member 1345 to move the sleeve 1315 relative to the ball 1330. The upper piston member 1345 is disposed within the housings 1310, 1340, which are connected together using the coupler 1335, such as with threaded connections. The upper piston member 1345 is coupled to the lower piston member 1347, such as with a threaded connection. The lower piston member 1347 includes an upper shoulder that engages the spring 1350, which is retained at its opposite end by the housing 1360, which is coupled to the lower end of the housing 1340. The spring 1350 is surrounded by the housing 1340 and is located within a chamber 1353 that is in fluid communication with the bore of the isolation valve 1300 via an opening 1349 in the wall of the lower piston member 1347. The lower piston member 1347 extends through the housing 1360 and is coupled to the lower adapter 1395. A nozzle 1343 may be disposed in the bore of the isolation valve 1300 above the opening 1349 to restrict the flow fluid therethrough prior to communicating with the opening 1349 and to create a pressure differential across the upper and lower ends of the isolation valve 1300.

The upper piston member 1345, the lower piston member 1347, and the lower adapter 1395 are movable relative to the housings 1310, 1340, 1360, and may be controlled using a J-slot arrangement that is provided between the housing 1360 and the lower piston member 1347. The J-slot arrangement includes a channel 1363 machined in the inner wall of the housing 1360. The channel 1363 is shown in FIG. 13A-1 in a "rolled-out," flattened orientation. This pattern is preferably formed three times in the wall of housing 1360 so that each complete J-slot cycle covers 120 degrees of arc of the inner surface of housing 1360. The lower piston member 1347 includes a recessed shoulder that carries one or more rotatable lug rings 1365. The lug rings 1365 include an annular ring base which carries a projecting lug portion thereon.

FIG. 13A illustrates a first operational position of the isolation valve 1300 having both fluid pressure and flow through the bore of the isolation valve 1300. As the isolation valve 1300 is pressurized, fluid pressure is communicated to the chambers 1329, which generates a force (greater than the spring 1350 force) on the upper end of the upper piston member 1345, thereby moving the upper piston member 1345, the lower piston member 1347, and the lug rings 1365 relative to the housing 1360 until a shoulder on the upper piston member 1345 abuts the coupler 1335. The spring 1350 is compressed between the lower piston member 1347 and the housing 1360, and the lug rings 1365 are moved in an extended portion of the channel 1363 to the position shown in FIG. 13A-1. A shoulder on the upper end of the upper piston member 1345 engages a shoulder on the lower end of the sleeves 1315 and moves the sleeves 1315 and thus the pins 1317, 1319 to rotate the ball 1330 so that the bore of the ball 1330 permits fluid flow through the bore of the isolation valve 1300.

As illustrated in FIG. 13B, when the pressure in the isolation valve 1300 is reduced, the spring 1350 returns the lower piston member 1347, the upper piston member 1345, and the sleeves 1315, so that the ball 1330 is rotated using the pins 1317, 1319 into a closed position to prevent fluid flow through the bore of the isolation valve 1300. The lower piston member 1347 moves the lug rings 1356 relative to the housing 1360, and the lug rings 1356 are rotated and directed by the channel 1363 into the position shown in FIG. 13B-1, which may also stop the retraction of the spring 1350. As illustrated in FIG. 13C, pressure may then be applied above and to the isolation valve 1300 to conduct another operation, such as actuation of the expander assembly 25 described above, without opening fluid communication through the bore of the isolation valve 1300. The upper piston member 1345 is moved within a recess of the sleeve 1315 a limited distance relative to the sleeve 1315 until the lug rings 1365 are moved by the lower piston member 1347 and are rotated and directed by the channel 1363 into the position shown in FIG. 13C-1, which may prevent the upper piston member 1345 from moving the sleeves 1315 and potentially re-opening fluid communication through the isolation valve 1300. As illustrated in FIG. 13D, when the pressure in the isolation valve 1300 is reduced or removed, the spring 1350 returns the upper piston member 1345 back to the position shown in FIG. 13B. However, the lower piston member 1347 moves the lug rings 1356 into the channel 1363 to the position shown in FIG. 13D-1. From the position illustrated in FIG. 13D-1, when the isolation valve 1300 is pressurized again, the lug rings 1365 will be directed into an extended portion of the channel 1363 (similar to the position shown in FIG. 13A-1) to permit movement of the sleeve 1315 via the upper and lower piston members 1345, 1347, thereby moving the ball 1330 and opening fluid communication through the bore of the isolation valve 1300. The isolation valve 1300 can be opened and closed indefinitely by following this procedure.

Figure 14A:
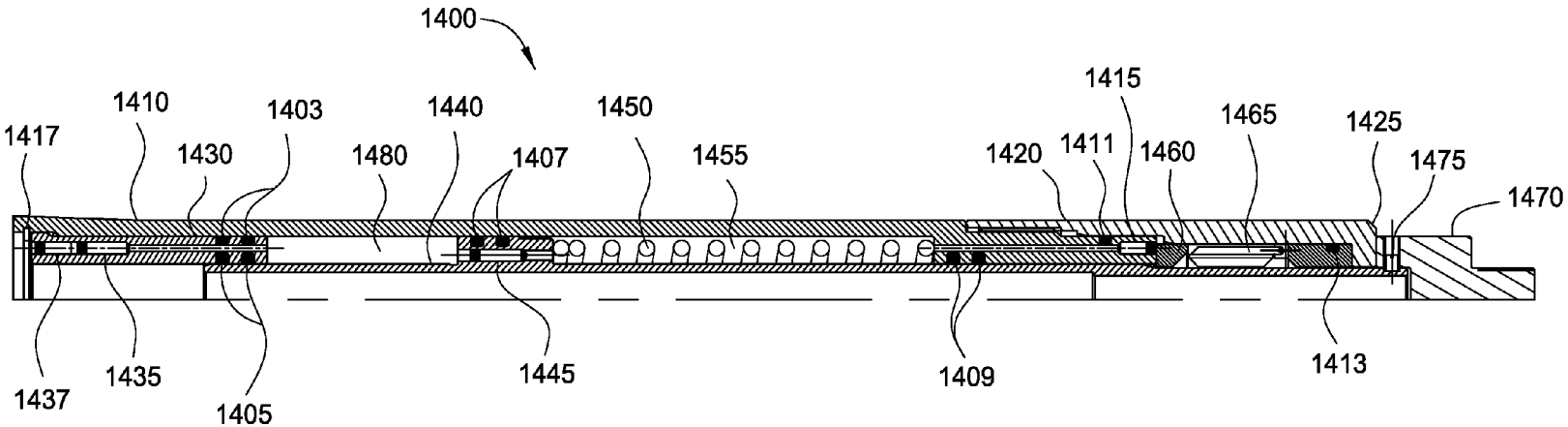
FIGS. 14A-C are half-sections of an isolation valve and illustrate the operation of the isolation valve, according to another embodiment of the invention.
Figure 14B:
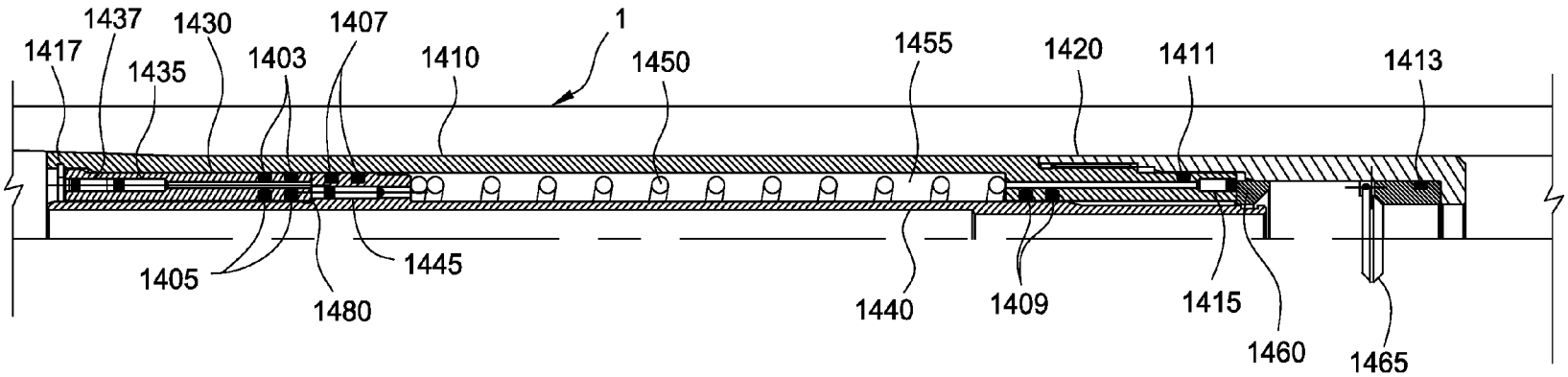
Figure 14C:
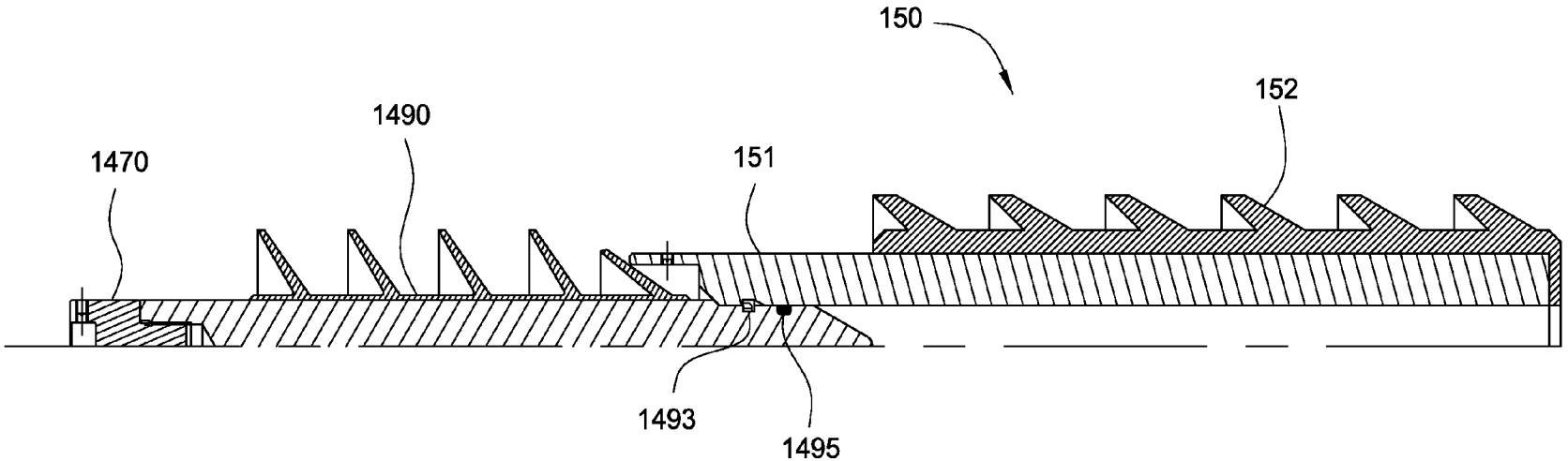

FIGS. 14A-C illustrate a cross-section of an isolation valve 1400, according to one embodiment of the invention. The isolation valve 1400 may be used instead of the isolation valve 200 described above. The isolation valve 1400 may include an upper housing 1410, a lower housing 1420, an upper mandrel 1430, a lower mandrel 1440, a retainer 1417, one or more seals, such as o-rings 1403, 1405, 1407, 1409, 1411, 1413, one or more biasing members, such as a spring 1450, a flapper valve insert 1460, a flapper valve 1465, an adapter 1470, and one or more frangible members, such as shear screws 1475.

The upper mandrel 1430 may include a cylindrical body having a bore disposed therethrough and one or more check valves 1435 located through the body of the upper mandrel 1430. The check valve 1435 may optionally include a removable plug 1437 to prevent fluid from escaping through the top end of the upper mandrel 1430. The upper mandrel 1430 may be coupled to the upper end of the upper housing 1410, which may also include a cylindrical body having a bore disposed therethrough. The retainer 1417 may include a snap ring disposed within the inner surface of the upper housing 1410 and may be operable to retain the upper mandrel 1430 within the upper housing 1410. The lower mandrel 1440 is disposed in the upper housing 1410 and extends through the lower housing 1420, and further includes a cylindrical body having a bore disposed therethrough that sealingly engages the upper mandrel 1430.

The lower mandrel 1440 includes a shoulder that sealingly engages the upper housing 1410 and has one or more check valves 1445 disposed through the wall of the shoulder. A chamber 1480 is formed between the bottom end of the upper mandrel 1430, the inner surface of the upper housing 1410, the outer surface of the lower mandrel 1440, and the top end of the shoulder of the lower mandrel 1440. The chamber 1480 is filled with a hydraulic fluid, such as silicon oil. The upper housing 1410 includes a shoulder at its lower end that sealingly engages the lower mandrel 1440 and the lower housing 1420 and has one or more check valves 1415 disposed through the wall of the shoulder. A chamber 1455 is formed between the bottom end of the shoulder of the lower mandrel 1440, the inner surface of the upper housing 1410, top end of the shoulder of the upper housing 1410, and the outer surface of the lower mandrel 1440. The chamber 1455 is filled with a hydraulic fluid, such as silicon oil. The check valve 1415 may be configured to allow some of the fluid to escape from the chamber 1455 as an increase in temperature may cause expansion of the fluid. The check valve 1445 may be configured to direct the fluid from the chamber 1455 into the chamber 1480 and prevent fluid flow in the reverse direction. The spring 1450 is housed in the chamber 1455 and is operable to telescope apart the lower mandrel 1440 and the upper housing 1410.

The lower housing 1420 is coupled to the upper housing 1410, such as through a threaded connection, and includes a cylindrical body having a bore disposed therethrough. A recess in the inner surface of the lower housing 1420 is configured to retain the flapper valve insert 1460, which supports the flapper valve 1465 and abuts the bottom end of the upper housing 1410. The flapper valve insert 1460 and the flapper valve 1465 are further retained by the outer surface of the lower mandrel 1440. The lower end of the lower mandrel 1440 is positioned to maintain the flapper valve 1465 in an open position, which includes a spring member configured to bias the flapper valve 1465 into a closed position when unrestrained. The lower mandrel 1440 is releaseably coupled to the adapter 1470 via the one or more shear screws 1475 below the lower housing 1420. The adapter 1470 includes a solid cylindrical member that provides a closed end of the isolation valve 1400 and is operable to couple the isolation valve 1400 to a device, such as a dart 1490 (shown in FIG. 14C) or a cement plug.

In operation, the isolation valve 1400 is coupled to the dart 1490 via the adapter 1470. The dart 1490 and the isolation valve 1400 may then be dropped from the surface of a wellbore into the setting tool 1, the liner assembly 100, or the wiper assembly 150 located in the wellbore. The dart 1490 may guide the isolation valve 1400 into the setting tool 1, the liner assembly 100, or the wiper assembly 150 until a shoulder 1425 of the lower housing 1420 engages and seals on a seat, such as a shoulder disposed in the bore of the seat 95, the seal assembly 75, the wiper assembly 150, or other similar component. In an optional embodiment, the isolation valve 1400 may also include a c-ring coupled to the outer surface of the lower housing 1420 that is operable to engage a corresponding shoulder or recess to secure the isolation valve 1400 within the setting tool 1, the liner assembly 100, or the wiper assembly 150. In one embodiment, the upper end of the upper housing 1410 may include a tapered shoulder configured to engage and seal on a seat, such as a shoulder disposed in the bore of the seat 95, the seal assembly 75, the wiper assembly 150, or other similar component.

After the isolation valve 1400 is secured, pressure above the isolation valve 1400 may be applied against the top of the adapter 1470 to shear the shear screws 1475 and release the adapter 1470 and the dart 1490 from the lower mandrel 1440 and open fluid communication through the isolation valve 1400. The release of the adapter 1470 and the dart 1490 from the lower mandrel 1440 allows the spring 1455 to move the lower mandrel 1440 to remove its lower end from preventing the flapper valve 1465 to bias into a closed position, as illustrated in FIG. 14B. The fluid in the chamber 1480 and the check valves 1435, 1445 provide a configuration operable to delay the closure of the flapper valve 1465 after the adapter 1470 is released from the lower mandrel 1440. As the chamber 1480 is collapsed between the upper mandrel 1430 and the lower mandrel 1440, the fluid in the chamber 1480 is prevented from flowing into the chamber 1455 by the check valve 1445 but is allowed to be slowly dissipated through the check valve 1435 into the bore of the isolation valve 1400. The pressure developed in the chamber 1480 after release of the lower mandrel 1440 may first release the plug 1437 from the flow path of the check valve 1435 to open fluid communication therethrough. As the fluid is ejected from the chamber 1480, the portion of the fluid remaining in the chamber 1480 provides a resistance to the force of the spring 1450 and slows the movement of the lower mandrel 1440. The sizing of the check valve 1435 may determine the rate at which the fluid is removed from the chamber 1480 and the sizing of the chamber 1480 may determine the amount of fluid which can be filled in the chamber 1480. These two factors may be used to provide a predetermined timed resistance against the force of the spring 1450 to delay the movement of the lower mandrel 1440 away from the flapper valve 1465 and thus the closure of the flapper valve 1465. During the time delayed closing of the flapper valve 1465, the released adapter 1470 and dart 1490 may be directed through the remaining assembly, such as the liner assembly 100, to facilitate removal of any remaining fluids, such as cement, from the assembly. As illustrated in FIG. 14C, the dart 1490 may include a c-ring 1493 and a seal 1495, such as an o-ring, configured to engage and seal with the body 151 of the wiper assembly 150, the operation of which may then begin as described above after engagement with the dart 1490 and during the time delayed closing of the flapper valve 1465. After the flapper valve 1465 closes fluid communication through the isolation valve 1400, pressure may then be applied above and to the isolation valve 1400 to conduct another operation, such as actuation of the expander assembly 25 described above, without opening fluid communication through the bore of the isolation valve 1400.

Figures 1, 15A, 15B, 15C, 15D:
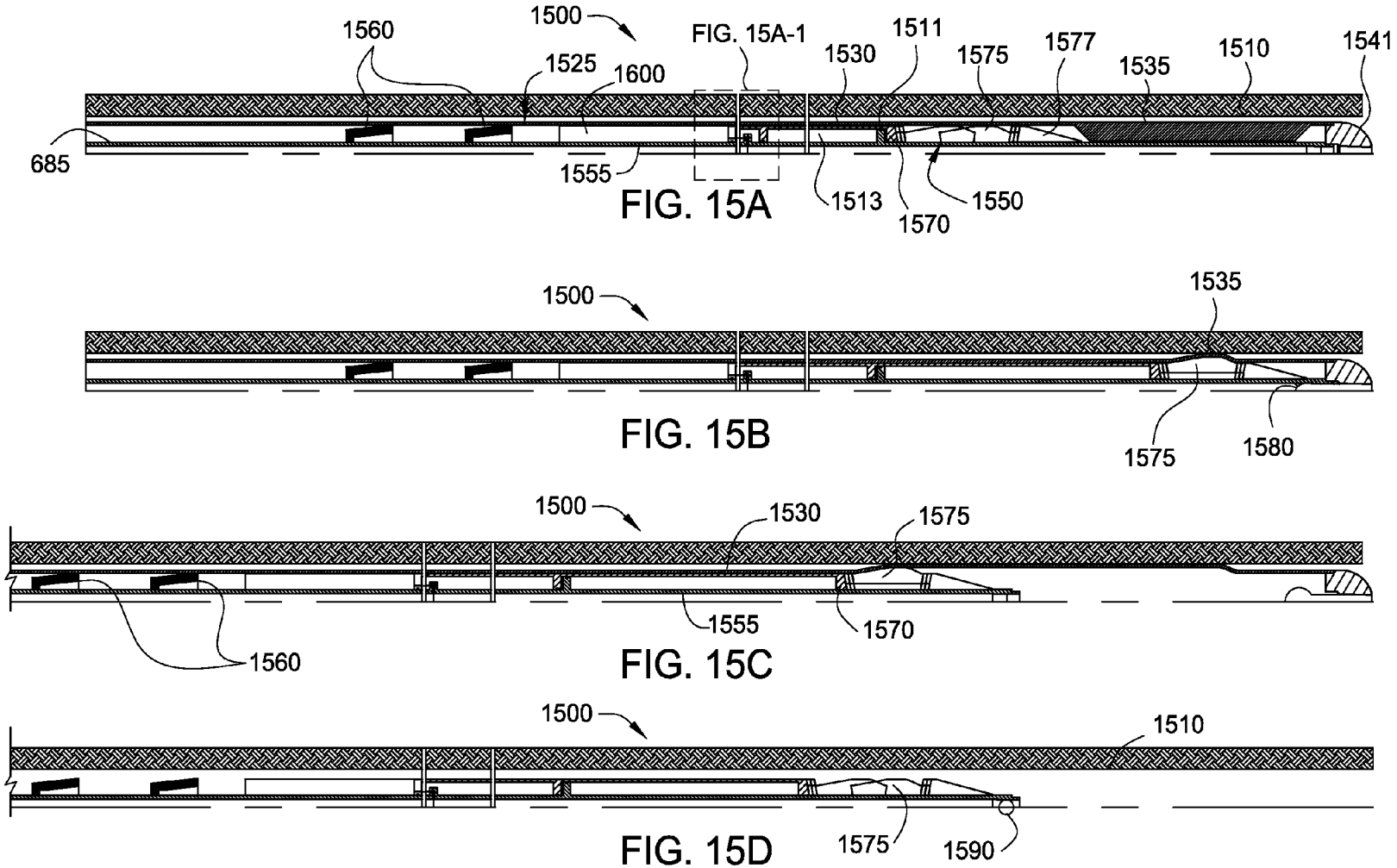
Figures 1, 15A:
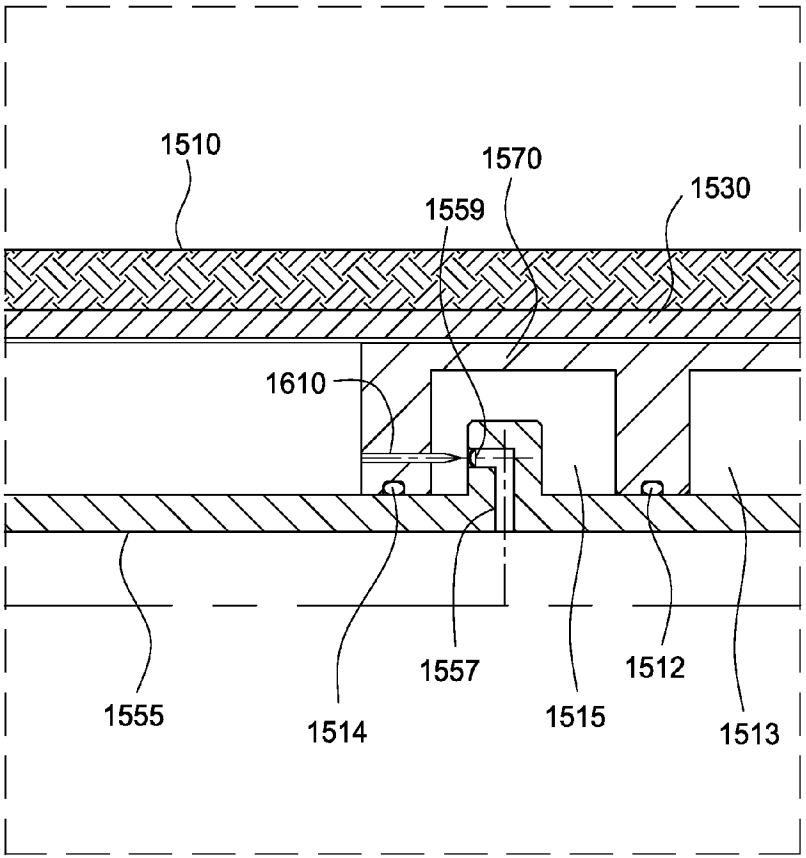
Figures 1, 15C:
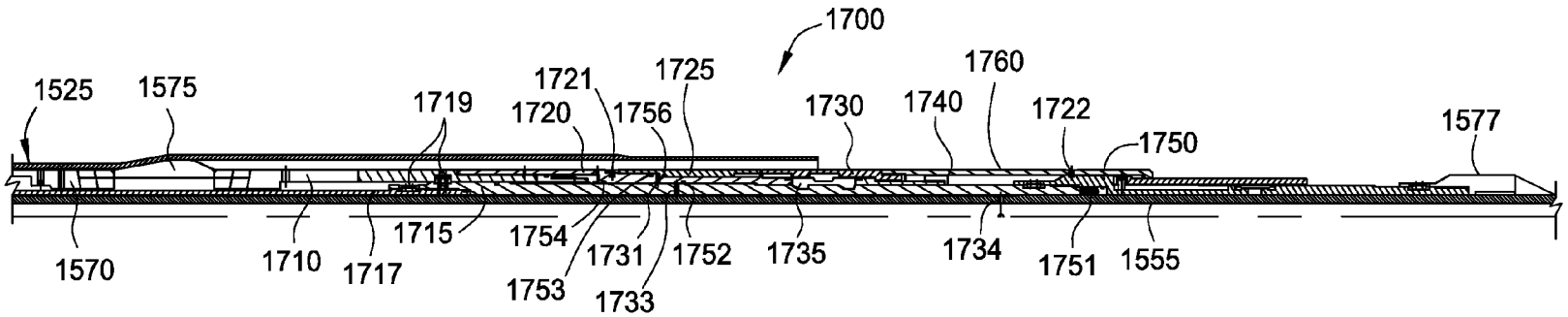
Figures 1, 15D:
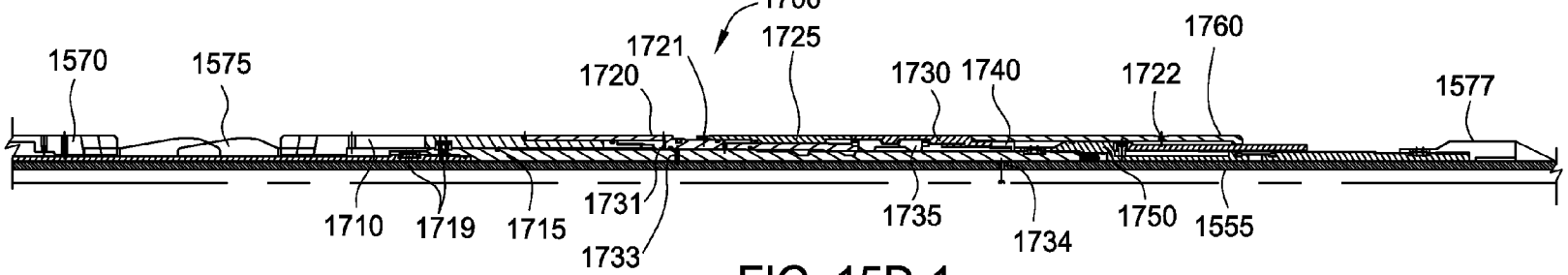
Figures 2, 15D:
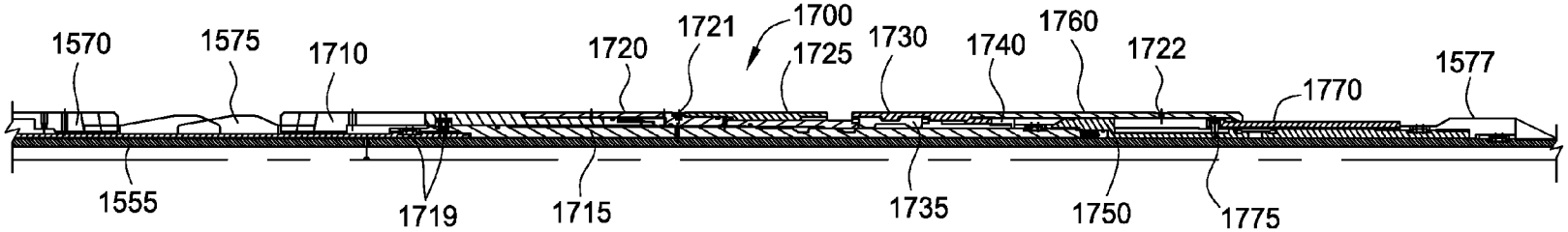

FIG. 15A is a sectional view of an expandable liner system 1500 disposed in a wellbore 1510 according to one embodiment of the invention. The expandable liner system 1500 may be run-into the wellbore 1510 using the run-in string 685. The system 1500 may include a liner assembly 1525 and an expander assembly 1550. In one embodiment, the expandable liner system 1500 may be located proximate a lower end of a string of casing and the liner assembly 1525 may be set in the casing by positioning an upper portion of the liner assembly 1525 in an overlapping relationship with a lower portion of the casing. Thereafter, the expansion assembly 1550 may be employed to expand the liner assembly 1525 into engagement with the casing and/or the surrounding wellbore 1510.

The liner assembly 1525 may include a tubular section 1530 at an upper end thereof and a shaped or a corrugated liner section 1535 disposed at the lower end thereof. It must be noted that the shape or corrugation of the liner section 1535 is optional such that the liner section 1535 is substantially cylindrical. Alternatively, the corrugated liner section 1535 may be located at any position along the liner assembly 1525. A cross section of a suitable corrugated liner section may be found at FIG. 2G of U.S. Pat. No. 7,121,351, which is herein incorporated by reference in its entirety. The corrugated liner section 1535 and the substantially cylindrical liner section 1530 may be connected by a threaded connection or may be one continuous tubular body. The corrugated liner section 1535 may be fabricated from a drillable material, such as aluminum or a pliable composite. The corrugated liner section 1535 may have a folded wall having an initial inner diameter which may be reformed to define a larger second folded inner diameter and subsequently may be expanded to an even larger unfolded diameter. The corrugated liner section 1535 may be folded or deformed prior to insertion into the wellbore 1510, to a non-tubular-shape, such as a hypocycloid, so that grooves are formed along the length of the corrugated liner section 1535. The grooves may be symmetric or asymmetric.

The liner assembly 1525 may further include a shoe 1540 at the lower end thereof. The shoe 1540 may be longitudinally coupled to the corrugated portion, such as by a threaded connection. The shoe 1540 may be a tapered or bullet-shaped and may guide the liner assembly 1525 toward the center of the wellbore 1510. The shoe 1540 may minimize problems associated with hitting rock ledges or washouts in the wellbore 1510 as the liner assembly 1525 is lowered into the wellbore. An outer portion of the shoe 1540 may be made from steel. An inner portion of the shoe 1540 may be made of a drillable material, such as cement, aluminum or thermoplastic, so that the inner portion may be drilled through if the wellbore is to be further drilled. A bore may be partially formed longitudinally through the shoe 1540 and in fluid communication with the wellbore 1510.

The expander assembly 1550 may be disposed in the liner assembly 1525. The expander assembly 1550 may include a tubular mandrel 1555. An upper end of the mandrel 1555 may be connected to the run-in string 685 by a threaded connection and a lower end of the mandrel 1555 may be releasably connected to the shoe 1540, such as by a threaded connection. The mandrel 1555 may have a bore formed therethrough in fluid communication with the surface of the wellbore 1510 via a bore of the run-in string 685. The mandrel 1555 may support the liner assembly 1525 during run-in.

The expander assembly 1550 may further include one or more seals 1560 longitudinally coupled to the mandrel 1555 and engaged with an inner surface of the tubular portion 1530. The seals 1560 may be fabricated from a pliable material, such as an elastomer. The seals 1560 may act as a piston to move the expansion assembly 1550 through the tubular section 1530 upon introduction of fluid pressure below the seals 1560. Additionally or alternatively, tension from the run-in string may 685 be used to move the expansion assembly 1550 through the tubular section 1530.

The expander assembly 1550 may further include a piston member 1570 disposed between the tubular section 1530 and the mandrel 1555 and movable relative to the tubular section and the mandrel. As illustrated in FIG. 15A-1, the piston member 1570 may form one or more vacuum chambers 1513 and one or more piston chambers 1515 with the mandrel 1555. One or more seals, such as o-rings 1511, 1512, and 1514 may be used to seal the chambers 1513 and 1515. The mandrel 1555 may include a shoulder disposed on its outer surface having a flow path 1557 providing fluid communication between the bore of the mandrel 1555 and the piston chamber 1515. A valve 1559, such as a rupture disk, may be located in the flow path 1557 to control fluid communication to the piston chamber 1515.

The expander assembly 1550 may further include a valve 1600 having a member 1610, such as a pick, configured to actuate the valve 1559 to open fluid communication between the mandrel 1555 bore and the piston chamber 1515 for actuation of the piston member 1570. In one embodiment, the valve 1600 may include the electronics package 650 or the RFID electronic package 800 described above. The valve 1600 may be actuated using an active or passive RFID tag embedded in a device, such as a dart 1580, shown in FIG. 15B, or using mud pulses received from the surface. In one embodiment, alternative means of operating the valve 1600 may include a spring force, a gas spring, or an electric motor. In one embodiment, actuation of the valve 1600 may cause the member 1610, such as a pick, to fracture the valve 1590, such as a rupture disk, thereby opening fluid communication between the bore of the mandrel 1555 and the piston chamber 1515.

The expansion assembly 1550 further includes a two-position expander 1575 and a cone 1577. The cone 1577 is a tapered member that is operatively attached to the piston member 1570, whereby movement of the piston member 1570 in relation to the liner assembly 1525 will also move the cone 1577. Adjacent to the cone 1577 is the two-position expander 1575. During run-in, both the two-position expander 1575 and the cone 1577 are disposed adjacent an end of the corrugated liner section 1535.

Detailed views of a suitable two-position expander may be found at FIGS. 3A and 3B of U.S. Pat. No. 7,121,351. The two-position expander 1575 may include a first assembly and a second assembly. The first assembly may include a first end plate and a plurality of first cone segments and the second assembly may include a second end plate and a plurality of second cone segments. Each end plate may be substantially round and have a plurality of T-shaped grooves formed therein. Each groove may match a T-shaped profile formed at an end of each cone segment.

An outer surface of each cone segment may include a first taper and an adjacent second taper. The first taper may have a gradual slope to form the leading shaped profile of the two-position expander 1575. The second taper may have a relatively steep slope to form the trailing profile of the two-position expander 1575. The inner surface of each cone segment may have a substantially semi-circular shape to allow the cone segments to slide along an outer surface of the mandrel 1555. A track portion may be formed on each first cone segment. The track portion may be used with a mating track portion formed on each second cone segment to align and interconnect the cone segments. The track portions may be a tongue and groove arrangement.

The first assembly and the second assembly may be urged longitudinally toward each other along the mandrel. As the first assembly and the second assembly approach each other, the first and second cone segments may be urged radially outward. As the first and second segments travel longitudinally along respective track portions, a front end of each second cone segment wedges the first cone segments apart, thereby causing the first shaped profiles to travel radially outward along the first shaped grooves of the first end plate. Simultaneously, a front end of each first cone segment wedges the second cone segments apart, thereby causing the second shaped profiles to travel radially outward along the second shaped grooves of the second end plate. The radial and longitudinal movement of the cone segments continues until each front end contacts a stop surface on each end plate, respectively. In this manner, the two-position expander 1575 is moved from a retracted position having a first diameter to an expanded position having a second diameter that is larger than the first diameter.

In operation, the expandable liner system 1500 may be lowered into the wellbore 1510 adjacent an area of interest, such as an end of an existing casing section. Wellbore fluids may flow up through the bore of the mandrel 1555 and the run-in string 685 as the system 1500 is run into the wellbore 1510. A dart 1580 may be dropped from the surface of the wellbore 1510, directed through the expandable liner system 1500, and seated in the shoe 1540, thereby closing fluid communication between the wellbore 1510 and the bore of the mandrel 1555. The dart 1580 may include an embedded RFID tag used to communicate with the valve 1600. A radio frequency communication may be directed between the dart 1580 and the valve 1600 to actuate the valve 1600 and move the member 1610 to open the valve 1559. The pressure in the bore of the mandrel 1555 may be increased and communicated to the piston chamber 1513 via the flow path 1557 to move the piston member 1570. The piston member 1570 causes the two-position expander 1575 and the cone 1577 to move relative to the mandrel 1555 and the liner assembly 1525, thereby allowing the cone 1577 to reform the corrugated liner section 1535. The cone 1577 reforms the corrugated liner section 1535 and may engage a shoulder disposed on the outer surface of the mandrel 1555 or the end of the shoe 1540, which prevents further movement of the cone 1577. Fluid pressure continues to be introduced into the piston chamber 1515, thereby causing the two-position expander 1575 to move closer to the cone 1577 to begin the activating process. As the fluid pressure continues to urge the two-position expander 1575 against the cone 1577, the first and second cone segments of the two-position expander 1575 move radially outward into contact with the surrounding liner 1535 (actuation of the two-position expander 1575 was described above).

FIG. 15C illustrates the two-position expander 1575 expanding the corrugated liner section 1535 and the liner section 1530. As shown, the two-position expander 1575 has expanded a portion of the liner section 1535 from the folded diameter to the unfolded diameter. In other words, during the expansion process, the two-position expander 1575 basically "irons out" the crinkles in the corrugated liner section 1535 so that the liner section 1535 is substantially reformed into its initial tubular shape. Reforming and subsequently expanding allows further expansion of the liner section 1535 than was previously possible because the reformation process may not use up the 25% limit on expansion past the elastic limit. Subsequently, the expansion assembly 1550 is rotated in one direction to release the connection between the mandrel 1555 and the shoe 1540 and/or dart 1580. At this point, the expansion assembly 1550 and the liner assembly 1525 are disconnected, thereby unlocking the one or more seals 1560. As additional fluid pressure is introduced through the bore of the mandrel 1555, the entire expansion assembly 1550 is moved relative to the liner assembly 1525 as fluid pressure acts upon seals 1560. In this manner, substantially the entire length of liner sections 1530 and 1535 are expanded into contact with the surrounding wellbore 1510.

FIG. 15D illustrates the removal of the expander assembly 1550 from the liner assembly 1525. As illustrated, a device 1590, such as a ball, may be dropped from the surface of the wellbore 1510 and landed into a seat of the mandrel 1555, thereby closing fluid communication between the bore of the mandrel 1555 and the surrounding annulus of the wellbore 1510. Pressure may then be increased in the expander assembly 1550 and used to collapse the two-position expander 1575 into an unexpanded (reduced outer diameter) position to facilitate removal of the expander assembly 1550. The cone segments of the two-position expander 1575 may be retracted to provide a reduced outer diameter of the expansion assembly 1550 to allow the assembly to be removed from the liner assembly 1525 and/or the wellbore 1510.

FIGS. 15C-1, 15D-1, and 15D-2 illustrate an embodiment of the expander assembly 1550 having a release mechanism 1700 used to retract the two-position expander 1575 into an unexpanded position as stated above. The release mechanism 1700 is configured to retract the two-position expander 1575 into an unexpanded position using fluid pressure and/or mechanical rotation of the expander assembly 1550. The release mechanism 1700 may be disposed between the two-position expander 1575 and the cone 1577 of the expansion assembly 1550.

The release mechanism 1700 may include an adapter 1710 coupled to the two-position expander 1575 at an upper end and rotatively coupled to a first inner mandrel 1715 via one or more screws 1719. The screws 1719 may reside in a slot in the body of the adapter 1710 to allow relative axial movement between the adapter 1710 and the first inner mandrel 1715. The adapter 1710 and the first inner mandrel 1715 may include cylindrical members having bores disposed through the bodies of the members. The first inner mandrel 1715 may similarly be coupled at its upper end to a mandrel 1717, which is disposed between the two-position expander 1575 and the mandrel 1555 and is operable to facilitate make-up of the expander assembly 1500 and the release mechanism 1700.

The release mechanism 1700 may include an upper sleeve 1720, a middle sleeve 1725, and a lower sleeve 1730, each comprising cylindrical members having bores located through the bodies of the members. The upper sleeve 1720 may abut a shoulder disposed on the outer surface of the adapter 1710 and may be releaseably coupled to the middle sleeve 1725 via one or more frangible members, such as shear screws 1721. An opening 1731 is disposed through the body of the upper sleeve 1720, which is in communication with a chamber formed between the upper sleeve 1720 and the middle sleeve 1725. The chamber is sealed using one or more seals, such as o-rings 1754, 1753, 1756, and 1752. The chamber is also in communication with an opening 1733 disposed through the body of the first inner mandrel 1715, which is further in communication with an opening 1734 disposed through the body of the mandrel 1555 and thus the inner bore of the expander assembly 1550. When the inner bore of the expander assembly 1550 is pressurized, the fluid pressure is directed to the chamber via the openings 1734, 1733, 1731, which then telescopes apart the upper sleeve 1720 and the middle sleeve 1725 to shear the shear screws 1721 and allow relative movement between the upper and middle sleeves. The pressure also telescopes apart the adapter 1720 and the upper and middle sleeves 1720, 1725 relative to the first inner mandrel 1715.

As illustrated in FIG. 15C-1, a set of dogs 1735 may be located in a slot of the upper sleeve 1720 and may extend into recesses disposed on the outer surface of the first inner mandrel 1715. The dogs 1735 may include a cylindrical member having one or more shoulder portions extending from the inner diameter and one or more recesses disposed on the outer diameter of the member. The dogs 1735 may be surrounded by the lower sleeve 1730, which is coupled to the upper end of a lower housing 1760. The lower sleeve 1730 engages the outer surface of the dogs 1735 adjacent the recesses disposed on the outer diameter of the dogs 1735 to prevent the dogs 1735 from releasing engagement with the first inner mandrel 1715. The dogs 1735 are engaged with the first inner mandrel 1715 to prevent relative movement between the adapter 1710 (via the upper sleeve 1720) and the first inner mandrel 1715, thereby preventing retraction of the two-position expander 1575. A guide member 1740 is coupled to the lower end of the upper sleeve 1720 to facilitate translation of the upper sleeve 1720 relative to the lower housing 1760. The housing 1760 may be releasebly coupled to a second inner mandrel 1750 via one or more frangible members, such as shear screws 1722. The second inner mandrel 1750 may also be coupled to the first inner mandrel 1715 at one end and the cone 1577 at the opposite end. A seal, such as a packing element 1751, may be disposed between the first inner mandrel 1715, the second inner mandrel 1750, and the mandrel 1555.

As illustrated in FIG. 15D-1, the device 1590 (shown in FIG. 15D) may close fluid communication through the expander assembly 1550 and allow the bore of the mandrel 1555 to be pressurized, which may be communicated to the chamber between the upper sleeve 1720 and the middle sleeve 1725. The shear screws 1721 between the upper sleeve 1720 and the middle sleeve 1725 (and the shear screws 1722 between the lower housing 1760 and the second inner mandrel 1750) have been sheared (as described above) and the middle sleeve 1725 is used to direct a shoulder portion on the inner diameter of the lower sleeve 1730 into the recesses on the outer diameter the dogs 1735. This engagement allows the dogs 1735 to move radially outward away from the first inner mandrel 1715. The upper sleeve 1720 directs the dogs 1735 axially relative to the first inner mandrel 1715 to allow the dogs to disengage from the recesses in the first inner mandrel 1715 and retract into the middle sleeve 1725. When the dogs 1735 are disengaged from the first inner mandrel 1715, the adapter 1710 may move downward relative to the first inner mandrel 1715 to retract and pull apart the two-position expander 1575. The movement relative to the first inner mandrel 1715 may be stopped when the guide member 1740 abuts the upper end of the second inner mandrel 1750. The expander assembly 1550 may then be removed from the wellbore with the two-position expander 1775 in the retracted position.

As illustrated in FIG. 15D-2, the two-position expander 1575 may be retracted into an unexpanded position by rotation of the mandrel 1555. Rotation of the mandrel 1555 may be used to induce relative movement between the second inner mandrel 1570 and the lower housing 1760 and thus shear the shear screws 1722 therebetween. Release of the shear screws 1722 allows the middle sleeve 1730 to move relative to the dogs 1735, which may then retract into the middle sleeve 1730 and radially outward relative to the first inner mandrel 1715 as described above. Relative movement between the upper sleeve 1720 and the first inner mandrel 1715 may allow the lower end of the upper sleeve 1720 to move the dogs 1735 out of the recesses in the first inner mandrel 1715 and release the engagement therebetween to allow retraction of the two-position expander 1775 into the unexpanded position.

Any of the above discussed setting tools and/or liner assemblies may be installed in a pre-drilled wellbore or drilled in using a drilling with liner operation. Further, any of the above discussed setting tools may be used with a conventional liner hanger, discussed in the Background section. Further, any of the setting tool actuators may be used for the isolation valves and vice versa.

While the foregoing is directed to embodiments of the present invention, other and further embodiments of the invention may be devised without departing from the basic scope thereof, and the scope thereof is determined by the claims that follow.

The invention claimed is:

1. An expandable liner system for use in a wellbore, comprising:
- an expandable liner; and
- an expander assembly disposed in the expandable liner and comprising:
  - a mandrel releasably connected to the expandable liner;
  - a seal longitudinally coupled to the mandrel and engaged with an inner surface of the expandable liner;
  - a two position expander disposed along the mandrel and having a plurality of first cone segments and a plurality of second cone segments movable between an expanded position and a retracted position;
  - a hydraulic actuator in fluid communication with a bore of the mandrel and operable to move the two position expander from the retracted position to the expanded position; and
  - a valve having a valve member for facilitating pressurization of the mandrel bore in a closed position, an actuator for closing the valve member, and an electronics package for operating the actuator in response to receiving an instruction signal via wireless telemetry,
  - wherein:
    - the wireless telemetry is radio frequency identification (RFID), and
    - the electronics package comprises a receiver located adjacent to a bore of the mandrel for receiving the instruction signal from an RFID tag travelling through the bore.

2. The liner system of claim 1, wherein:
- the valve member is a sleeve for covering ports formed though a wall of the mandrel in the closed position, and
- the valve has a ball seat for receiving a ball having the RFID tag.

3. The liner system of claim 1, wherein:
- the expandable liner is part of a liner assembly further comprising a shoe coupled to the expandable liner, and
- the mandrel is releasably connected to the shoe by a threaded connection.

4. The liner system of claim 3, wherein the liner assembly further comprises a corrugated liner coupling the shoe to the expandable liner.

5. The liner system of claim 3, wherein:
- the shoe has a bore formed partially therethrough and radial port formed therethrough and in fluid communication with the bore, and
- the shoe has a sleeve disposed in the bore and longitudinally movable between an open position exposing the ports and a closed position covering the ports.

6. The liner system of claim 1, further comprising a hydraulic release mechanism in fluid communication with the mandrel bore and operable to move the two position expander from the expanded position to the retracted position.

7. An expandable liner system for use in a wellbore, comprising:
- an expandable liner; and
- an expander assembly disposed in the expandable liner and comprising:
  - a mandrel releasably connected to the expandable liner;
  - a seal longitudinally coupled to the mandrel and engaged with an inner surface of the expandable liner;
  - a two position expander disposed along the mandrel and having a plurality of first cone segments and a plurality of second cone segments movable between an expanded position and a retracted position;
  - a hydraulic actuator in fluid communication with a bore of the mandrel and operable to move the two position expander from the retracted position to the expanded position; and
  - a valve having a valve member for facilitating pressurization of the mandrel bore in a closed position, an actuator for closing the valve member, and an electronics package for operating the actuator in response to receiving an instruction signal via wireless telemetry, wherein:
  - the wireless telemetry is radio frequency identification (RFID),
  - the valve member is a sleeve for covering ports formed though a wall of the mandrel in the closed position, and
  - the valve has a ball seat for receiving a ball having an RFID tag.

* * * * *

UNITED STATES PATENT AND TRADEMARK OFFICE

CERTIFICATE OF CORRECTION

PATENT NO. : 8,783,343 B2
APPLICATION NO. : 13/973120
DATED : July 22, 2014
INVENTOR(S) : Giroux et al.

It is certified that error appears in the above-identified patent and that said Letters Patent is hereby corrected as shown below:

On the Title Page, Item [60]

Insert --filed on May 5, 2008-- after 61/050,511.

Signed and Sealed this
Seventh Day of October, 2014

Michelle K. Lee

Michelle K. Lee
*Deputy Director of the United States Patent and Trademark Office*